US011415902B2

(12) United States Patent
Watanabe et al.

(10) Patent No.: US 11,415,902 B2
(45) Date of Patent: Aug. 16, 2022

(54) TONER

(71) Applicant: CANON KABUSHIKI KAISHA, Tokyo (JP)

(72) Inventors: Shuntaro Watanabe, Hadano (JP); Hiroki Akiyama, Suntou-gun (JP); Hiroki Kagawa, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 98 days.

(21) Appl. No.: 16/987,902

(22) Filed: Aug. 7, 2020

(65) Prior Publication Data

US 2021/0055667 A1 Feb. 25, 2021

(30) Foreign Application Priority Data

Aug. 21, 2019 (JP) ..... JP2019-151240

(51) Int. Cl.
*G03G 9/087* (2006.01)

(52) U.S. Cl.
CPC ..... *G03G 9/08728* (2013.01); *G03G 9/08755* (2013.01); *G03G 9/08782* (2013.01); *G03G 9/08793* (2013.01)

(58) Field of Classification Search
CPC ..... G03G 9/0821; G03G 9/08755; G03G 9/08788
See application file for complete search history.

(56) References Cited

U.S. PATENT DOCUMENTS

| | | | |
|---|---|---|---|
| 7,014,969 | B2 | 3/2006 | Yachi et al. |
| 7,645,553 | B2 | 1/2010 | Matsumura et al. |
| 8,603,712 | B2 | 12/2013 | Aoki et al. |
| 8,741,519 | B2 | 6/2014 | Watanabe et al. |
| 8,785,101 | B2 | 7/2014 | Kaya et al. |
| 8,846,284 | B2 | 9/2014 | Kinumatsu |
| 9,201,323 | B2 | 12/2015 | Nishikawa et al. |
| 9,250,548 | B2 | 2/2016 | Nomura et al. |
| 9,261,804 | B2 | 2/2016 | Yamazaki et al. |
| 9,309,349 | B2 | 4/2016 | Watanabe et al. |
| 9,341,970 | B2 | 5/2016 | Yoshiba et al. |
| 9,429,860 | B2 | 8/2016 | Kinumatsu et al. |
| 9,470,993 | B2 | 10/2016 | Nishikawa et al. |
| 9,606,462 | B2 | 3/2017 | Nomura et al. |

(Continued)

FOREIGN PATENT DOCUMENTS

| | | |
|---|---|---|
| JP | 2007-114635 | 5/2007 |
| JP | 2010-145929 | 7/2010 |
| JP | 2018-156074 | 10/2018 |

OTHER PUBLICATIONS

U.S. Appl. No. 17/012,889, Takuya Mizuguchi, filed Sep. 4, 2020.

*Primary Examiner* — Peter L Vajda
(74) *Attorney, Agent, or Firm* — Venable LLP

(57) ABSTRACT

A toner comprising a resin that contains an amorphous segment and a crystalline segment as a binder resin, wherein a proportion of a tetrahydrofuran-insoluble matter of a resin component is from 40% by mass to 80% by mass; in differential scanning calorimeter measurement of the tetrahydrofuran-insoluble matter, where a temperature of a maximum endothermic peak is denoted by Tm [° C.] and an endothermic quantity is denoted by H(I) [J/g], the following formulas (1) and (2) are satisfied:

$$55.0 \leq Tm \leq 80.0 \quad (1)$$

$$10.0 \leq H(I) \leq 80.0 \quad (2).$$

14 Claims, 2 Drawing Sheets

(56) References Cited

U.S. PATENT DOCUMENTS

| | | | | |
|---|---|---|---|---|
| 9,625,844 | B2 | 4/2017 | Kaya et al. | |
| 9,658,554 | B2 | 5/2017 | Kinumatsu et al. | |
| 9,798,256 | B2 | 10/2017 | Kosaki et al. | |
| 9,798,262 | B2 | 10/2017 | Toyoizumi et al. | |
| 9,811,016 | B2 | 11/2017 | Aoki et al. | |
| 9,823,595 | B2 | 11/2017 | Toyoizumi et al. | |
| 9,829,818 | B2 | 11/2017 | Yoshiba et al. | |
| 9,857,713 | B2 | 1/2018 | Kosaki et al. | |
| 9,869,943 | B2 | 1/2018 | Aoki et al. | |
| 10,101,683 | B2 | 10/2018 | Nishikawa et al. | |
| 10,409,180 | B2 | 9/2019 | Koji et al. | |
| 10,747,134 | B2 | 8/2020 | Watanabe et al. | |
| 10,768,540 | B2 | 9/2020 | Watanabe et al. | |
| 2010/0035171 | A1 | 2/2010 | Watanabe et al. | |
| 2016/0139522 | A1 | 5/2016 | Yoshiba et al. | |
| 2016/0161874 | A1 | 6/2016 | Yamazaki et al. | |
| 2019/0384192 | A1 | 12/2019 | Kagawa et al. | |
| 2019/0384195 | A1 * | 12/2019 | Saeki ..... | G03G 9/08728 |
| 2020/0081361 | A1 | 3/2020 | Yoshiba et al. | |
| 2020/0285164 | A1 | 9/2020 | Akiyama et al. | |

* cited by examiner

TONER

BACKGROUND OF THE INVENTION

Field of the Invention

The present invention relates to a toner suitable in an image forming method using an electrophotographic method, an electrostatic recording method, or a toner jet recording method.

Description of the Related Art

In recent years, energy saving is considered to be a major technical issue even in the field of electrophotographic devices such as copiers and printers, and significant reduction in the amount of heat applied to a fixing device is needed in order to solve this issue. Therefore, a toner that can be fixed with a low amount of heat, that is, a toner having satisfactory low-temperature fixability is needed.

Conventionally, in order to enable fixing at a lower temperature, a method of making the binder resin as a sharper melt is known as one of the effective methods. In this respect, a toner using a crystalline resin has been introduced. Since crystalline resins do not show a clear glass transition due to the arrangement of molecular chains and have a property of not easily softening to a crystalline melting point, crystalline resins are being studied as materials that make it possible to achieve both heat-resistant storage stability and low-temperature fixability.

Further, the number of types of media has also been increasing. There is a great demand for bond paper having a large basis weight and a very uneven surface, and it is necessary to ensure the impregnation into the paper fibers of the bond paper by the sharp melting property of the crystalline resin. However, when a crystalline resin is used, although the sharp melt property is improved, the elasticity at high temperature is insufficient, and hot offset is likely to occur. Therefore, it is conceivable to ensure the elasticity at high temperature by mixing a crystalline resin and an amorphous resin, but in this case, sufficient sharp melt property cannot be exhibited.

Further, by controlling the crosslinked structure of the binder resin in a toner particle, it is possible to control the elasticity of the toner at high temperatures, but in the recesses of the bond paper, heat is less likely to be applied during the fixing process, and thus the plasticity of the crosslinked resin decreases, density unevenness occurs, and the low-temperature fixability decreases.

Japanese Patent Application Publication No. 2007-114635 indicates that using a block copolymer obtained by esterifying a crystalline polyester block and an amorphous block for a pulverized toner enables fixing by low temperature heating.

Further, Japanese Patent Application Publication No. 2010-145929 proposes a method for producing an electrophotographic toner including a step of melt-kneading a crystalline polyester, which is obtained by polycondensation of an alcohol component and a carboxylic acid component including an unsaturated aliphatic dicarboxylic acid compound, and an amorphous resin in the presence of a radical polymerization initiator.

In this document, recrystallization of the crystalline polyester is promoted in a cooling step after kneading by partially crosslinking the crystalline polyester with a carbon-carbon bond to increase the molecular weight.

Japanese Patent Application Publication No. 2018-156074 proposes a toner including a crystalline resin including a long-chain alkyl group and an amorphous resin. This document specifies the ratio of an endothermic quantity based on an endothermic peak derived from a crystalline resin (A) of a toner binder in a second temperature rising process after cooling from a first temperature rising process to an endothermic quantity based on an endothermic peak derived from the crystalline resin (A) in the first temperature rising process, the endothermic peaks being measured with a differential scanning calorimeter (DSC).

SUMMARY OF THE INVENTION

However, based on the results of investigation conducted on Japanese Patent Application Publication No. 2007-114635, the inventors of the present invention have found that where the block copolymer is used and heated at or above the melting point, the crystallinity of the crystalline resin may be destroyed, the sharp melt property is lowered and the low-temperature fixability is impaired.

Further, based on the results of investigation conducted on Japanese Patent Application Publication No. 2010-145929, the inventors of the present invention have found that where an attempt is made to maintain a state in which recrystallization is promoted, elasticity on the high temperature side becomes insufficient, hot offset is likely to occur, and density unevenness is likely to occur.

Further, based on the results of investigation conducted on the toner produced using the toner binder disclosed in Japanese Patent Application Publication No. 2018-156074, the inventors of the present invention have found that although the crystalline resin is excellent in sharp melting property, plasticization of the amorphous resin including a crosslinked structure is unlikely to advance and, therefore, the low-temperature fixability does not improve.

With these configurations, satisfactory results are not obtained for any of low-temperature fixability determined by sharp melt property, fixability on the high-temperature side (hot offset resistance), and elimination of density unevenness. As described above, further improvement is required for a toner in which a crystalline segment is introduced into a binder resin.

An object of the present invention is to provide a toner that ensures low-temperature fixability, hot offset resistance, and elimination of density unevenness.

A toner comprising a resin that contains an amorphous segment and a crystalline segment as a binder resin, wherein a proportion of a tetrahydrofuran-insoluble matter of a resin component is from 40% by mass to 80% by mass, the proportion is calculated by a following formula:

a proportion of a tetrahydrofuran-insoluble matter of a resin component=(a mass of a tetrahydrofuran-insoluble matter of a resin component in the toner)/(a mass of a resin component in the toner)×100, in differential scanning calorimeter measurement of the tetrahydrofuran-insoluble matter, where a temperature of a maximum endothermic peak is denoted by Tm [° C.] and an endothermic quantity is denoted by H(I) [J/g], the following formulas (1) and (2) are satisfied:

$$55.0 \leq Tm \leq 80.0 \quad (1)$$

$$10.0 \leq H(I) \leq 80.0 \quad (2)$$

According to the present invention, a toner that ensures low-temperature fixability, hot offset resistance, and elimination of density unevenness can be provided.

Further features of the present invention will become apparent from the following description of exemplary embodiments with reference to the attached drawings.

DESCRIPTION OF THE EMBODIMENTS

Figure 1:
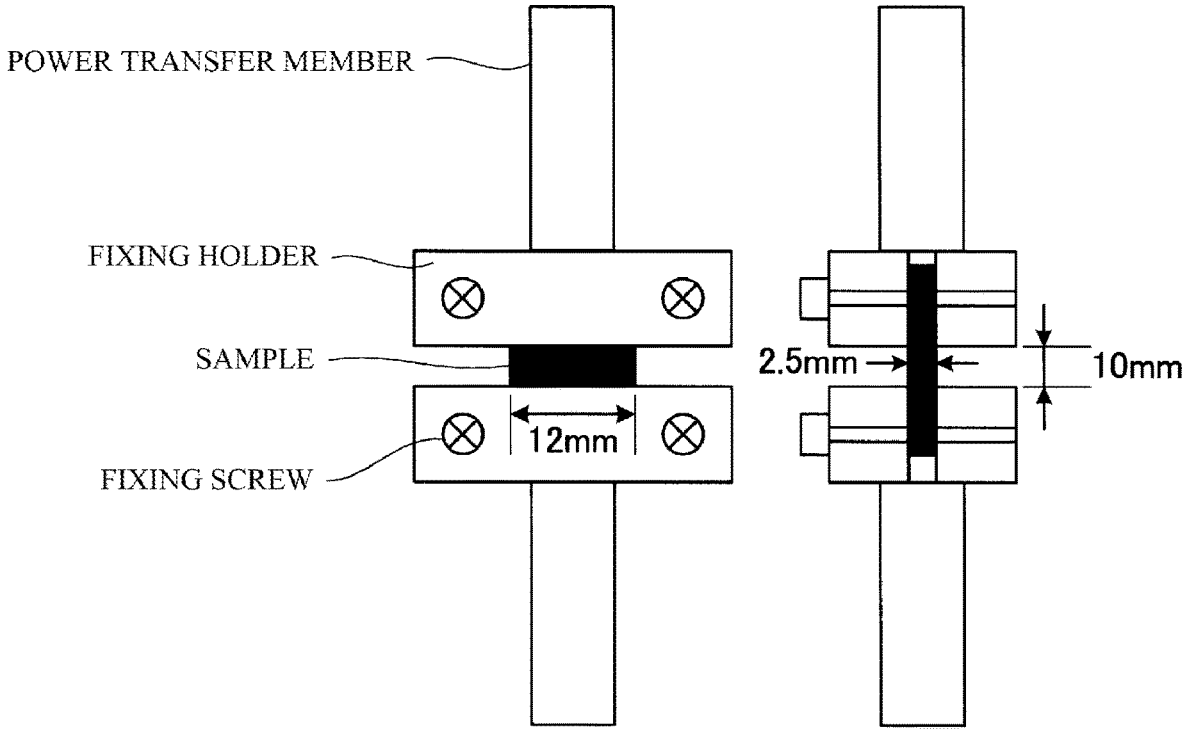
FIG. 1 is a schematic diagram of a measurement sample and a jig for measuring viscoelasticity.

Unless otherwise specified, the description of "from XX to YY" or "XX to YY" indicating a numerical range means a numerical range including a lower limit and an upper limit which are endpoints.

In the present description, when numerical ranges are described stepwise, the upper and lower limits of each numerical range can be arbitrarily combined.

A resin having crystallinity, as used herein, refers to a resin having a clear endothermic peak in differential scanning calorimeter measurement.

The toner will be explained below.

A fixing step in an electrophotographic process is a step of fixing the toner to a transfer material by applying heat and pressure to the toner for an extremely short time.

The toner includes a resin that contains an amorphous segment and a crystalline segment as a binder resin.

By introducing a crystalline segment as described in the background art, it has become possible to produce a toner with an excellent sharp melt property. The term "sharp melt property", as used herein, represents a behavior in which melting starts when the temperature is raised while applying heat to the toner.

Also, in order to impart hot offset resistance to the toner, a means for improving the elasticity of the amorphous segment can be considered. For example, elasticity can be controlled by introducing a crosslinked structure into the amorphous segment.

Therefore, there is a means for incorporating a crystalline segment that has the sharp melt property required for low-temperature fixability and an amorphous segment that retains the high-temperature elasticity required for imparting hot offset resistance into the binder resin of the toner.

However, in the case of using a binder resin obtained by simply mixing a crystalline resin having the crystalline segment and an amorphous resin having an amorphous segment which segments are characterized hereinabove, when the toner is melted in the fixing step, the melted crystalline resin is released from the toner particle, thereby causing hot offset. Further, at the time of fixing, where a transfer material such as bond paper having many uneven portions is used, the distance between the fixing member and the toner becomes non-uniform and the contact time varies, so that the heating becomes non-uniform. As a result, uneven melting of the toner is likely to occur, and uneven density (mottling) occurs on the image.

Further, where the amorphous segment has a crosslinked structure, the mobility of the molecular structure decreases, and the glass transition temperature rises, so that plasticization is unlikely to proceed at the time of fixing. Therefore, at the time of low-temperature fixing, when a transfer material such as bond paper is used, the adhesion between the toner particles becomes weak, a part of the fixed image is lost, and the fixed toner adheres to the roller or the like in the fixing process and white spots (missing portions) occur on the image.

Therefore, as a result of intensive studies, the present inventors have found that it is possible to eliminate any adverse effects by using a binder resin in which block polymerization of a crystalline segment and an amorphous segment has been advanced.

In the block-polymerized binder resin, the crystalline segment and the amorphous segment have a microphase-separated structure. Therefore, even if the crystalline segment is quickly plasticized in the fixing step, separation from the amorphous segment is prevented and hot offset resistance is improved. In addition, since the crystalline segment is plasticized, the amorphous segment is also sufficiently plasticized, so that the adhesion between the toner particles is promoted rapidly during low-temperature fixing, and therefore white spots are less likely to occur. In addition, since the toner base particles are likely to be uniformly melted, uneven density is eliminated.

In differential scanning calorimeter measurement using tetrahydrofuran (hereinafter, also referred to as THF) insoluble matter of the resin component in the toner, where the temperature of a maximum endothermic peak is denoted by Tm [° C.], and an endothermic quantity is denoted by H(I) [J/g], it is necessary to satisfy the following formulas (1) and (2).

$$55.0 \leq Tm \leq 80.0 \quad (1)$$

$$10.0 \leq H(I) \leq 80.0 \quad (2)$$

Where Tm is less than 55.0° C., the heat-resistant storage stability of the toner cannot be satisfied. Further, where Tm exceeds 80.0° C., the temperature applied to the transfer material at the time of fixing needs to be extremely high, and the low-temperature fixability deteriorates. Tm is preferably from 58.0° C. to 77.0° C., and more preferably from 60.0° C. to 77.0° C. Tm can be controlled by the composition of the crystalline resin.

Further, where the endothermic quantity H(I) is less than 10.0 J/g, block polymerization of the crystalline segment and the amorphous segment contained in the binder resin is insufficient, the plasticization of the amorphous segment does not progress, and white spots occur. In addition, where the endothermic quantity is low, the amorphous resin melts unevenly among the toner particles which results in uneven density and reduced hot offset resistance. The endothermic quantity H(I) is preferably 11.5 J/g or more, more preferably 13.0 J/g or more, and further preferably 16.5 J/g or more.

Meanwhile, where H(I) exceeds 80.0 J/g, the endothermic quantity will be too large, and therefore a large heat amount will be required to melt the entire toner. Therefore, in the image printed on a large number of sheets at high speed, sufficient heat for melting the toner cannot be ensured, the toner on the image is peeled off, and white spots are likely to occur. The endothermic quantity H(I) is preferably 65.0 J/g or less, more preferably 50.0 J/g or less, and further preferably 40.0 J/g or less.

H(I) can be controlled by the degree of bonding between the crystalline segment and the amorphous segment, and the degree of bonding can be controlled by the addition amount of the below-described polymerization initiator and the density of carbon-carbon bonds contained in the crosslinked polyester serving as a raw material for the amorphous segment.

The amount of the THF-insoluble matter in the resin component in the toner needs to be from 40% by mass to 80% by mass.

Where the insoluble matter ratio is less than 40% by mass, the high-temperature elasticity brought about by the crosslinked structure of the amorphous segment becomes insufficient, and hot offset resistance cannot be ensured. Where the insoluble matter ratio exceeds 80% by mass, the elasticity of the toner is too high, so that the low-temperature fixability is lowered and a fixing region cannot be sufficiently ensured. In addition, when a large number of prints are made in the fixing step, the melting unevenness of the toner becomes large, and image mottling occurs.

The proportion of a tetrahydrofuran-insoluble matter of a resin component is from 40% by mass to 80% by mass, the proportion is calculated by a following formula:

a proportion of a tetrahydrofuran-insoluble matter of a resin component=(a mass of a tetrahydrofuran-insoluble matter of a resin component in the toner)/(a mass of a resin component in the toner)×100.

The proportion of the THF-insoluble matter can be controlled by the composition and molecular weight of the crystalline segment and the amorphous segment and the degree of bonding between the crystalline segment and the amorphous segment, and the degree of bonding can be controlled by the addition amount of the below-described polymerization initiator and the density of carbon-carbon bonds contained in the crosslinked polyester serving as a raw material for the amorphous segment.

In the toner, the amorphous segment is preferably an amorphous modified resin segment (crosslinked polyester resin) in which a vinyl resin having crystallinity and a polyester resin are crosslinked with each other by carbon-carbon bonds. The crystal structure of the vinyl resin before crosslinking is destroyed by the crosslinking of the vinyl resin with the polyester resin, so that the modified resin segment becomes amorphous.

A method for producing the binder resin will be explained hereinbelow.

The binder resin preferably includes an amorphous crosslinked polyester resin segment, which is an amorphous segment and in which a vinyl resin having crystallinity and a polyester resin are crosslinked to each other by carbon-carbon bonds, and a vinyl resin segment which is a crystalline segment and has crystallinity.

For example, a mixing method in the case of mixing a crosslinked polyester resin, a vinyl resin having crystallinity, and additives may be a commonly known method. Examples of the mixing method include powder mixing, solvent mixing, melt mixing, and the like. Examples of mixing devices for powder mixing include a Henschel mixer, a Nauter mixer, a Banbury mixer, and the like. A Henschel mixer is preferred.

The following methods can be used as solvent mixing methods. A method of dissolving a crosslinked polyester resin and a vinyl resin having crystallinity in an organic solvent and homogenizing, followed by desolvation and pulverization, and a method of dissolving a crosslinked polyester resin and a vinyl resin having crystallinity in an organic solvent, dispersing in water, and then performing granulation and desolvation.

Melt mixing can be performed by a method of crosslinking a polyester resin having carbon-carbon double bonds while melt-mixing the polyester resin having carbon-carbon double bonds and a vinyl resin having crystallinity, and forming a crosslinked polyester resin to obtain a binder resin.

A mixing device for melt mixing can be exemplified by a batch-type mixing device such as a reaction tank and a continuous mixing device. A continuous mixing device is preferred for uniform mixing in a short time at an appropriate temperature. Examples of the continuous mixing device include a twin-screw extruder, a static mixer, an extruder, a continuous kneader, a triple roll, and the like.

Further, a crosslinked polyester resin, a vinyl resin having crystallinity, and additives may be mixed at the same time as the toner is produced. In this method, melt mixing which ensures homogeneous mixing and does not require solvent removal is preferable.

Among these methods, a method of crosslinking a vinyl resin having crystallinity and a polyester resin having carbon-carbon double bonds while performing melt-mixing is preferable. By this method, the carbon-carbon double bonds of the polyester resin having the carbon-carbon double bonds are reacted. This can also be carried out by a method of crosslinking by abstracting hydrogen atoms bonded to carbon atoms contained in the polyester resin having carbon-carbon double bonds by a hydrogen abstraction reaction caused by heating or the like.

Also, in this production method, the hydrogen abstraction reaction can be induced in the main chain of the vinyl resin having crystallinity at the same time by adding a radical initiator or the like. This makes it possible to react the polyester resin having carbon-carbon double bonds with the vinyl resin having crystallinity to achieve the block polymerization of the binder resin (conversion to crosslinked polyester resin).

As a specific method for performing such melt mixing, a mixture of a polyester resin having carbon-carbon double bonds and a vinyl resin having crystallinity is injected into, for example, a twin-screw extruder at a constant rate, a radical reaction initiator is also injected at a constant rate at the same time, and the reaction is preferably carried out while kneading and conveying at a temperature of from 100° C. to 200° C.

At this time, the polyester resin having carbon-carbon double bonds and the vinyl resin having crystallinity, which are reaction raw materials to be charged or injected into the twin-screw extruder, may be directly injected into the extruder without cooling from the respective resin reaction solutions. The once-produced resin may be cooled and pulverized and supplied to a twin-screw extruder.

A method of melt mixing is not limited to these specifically exemplified methods. For example, an appropriate method may involve charging the raw materials into a reaction vessel, heating to a temperature at which they are in a state of solution, and mixing.

The binder resin used in the toner may include the compound used during the polymerization of the vinyl resin having crystallinity and a residue thereof.

When producing the binder resin, from the viewpoint of improving the low-temperature fixability, hot offset resistance and heat-resistant storage stability, the mixing mass ratio (vinyl resin/polyester resin) of the vinyl resin having crystallinity to the polyester resin having carbon-carbon double bonds is preferably from 45/55 to 95/5, more preferably from 48/52 to 80/20, and further preferably from 50/50 to 70/30.

The mass ratio of the crystalline segment to the amorphous segment (crystalline segment/amorphous segment) in the binder resin is preferably from 18/82 to 65/35, and more preferably from 22/78 to 55/45.

The number average molecular weight Mn of the binder resin is preferably from about 5000 to 40,000, and more preferably from about 8000 to 20,000.

The weight average molecular weight Mw of the binder resin is preferably from about 10,000 to 80,000, more preferably from about 20,000 to 60,000.

The ratio (Mw/Mn) of the weight average molecular weight Mw to the number average molecular weight Mn in the binder resin is preferably from about 2.5 to 6.0, and more preferably from about 3.0 to 5.0.

The radical reaction initiator is not particularly limited, and examples thereof include inorganic peroxides, organic peroxides, azo compounds, and the like. Also, these radical reaction initiators may be used in combination.

The inorganic peroxide is not particularly limited, and examples thereof include hydrogen peroxide, ammonium persulfate, potassium persulfate, sodium persulfate, and the like.

The organic peroxide is not particularly limited, and examples thereof include benzoyl peroxide, di-t-butyl peroxide, t-butylcumyl peroxide, dicumyl peroxide, α,α-bis(t-butylperoxy)diisopropylbenzene, 2,5-dimethyl-2,5-bis(t-butylperoxy)hexane, di-t-hexyl peroxide, 2,5-dimethyl-2,5-di-t-butylperoxyhexate, acetyl peroxide, isobutyl peroxide, octanoyl peroxide, decanoyl peroxide, lauroyl peroxide, 3,3,5-trimethylhexanoyl peroxide, m-toluyl peroxide, t-butyl peroxyisobutyrate, t-butyl peroxyneodecanoate, cumyl peroxyneodecanoate, t-butyl peroxy-2-ethylhexanoate, t-butyl peroxy-3,5,5-trimethylhexanoate, t-butyl peroxylaurate, t-butyl peroxybenzoate, t-butyl peroxyisopropylmonocarbonate, t-butyl peroxyacetate.

The azo compound or diazo compound is not particularly limited, and examples thereof include 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, azobisisobutyronitrile, and the like.

Among these, organic peroxides are preferable because they have high initiator efficiency and do not form toxic by-products such as cyanide compounds. Furthermore, since the crosslinking reaction proceeds efficiently and the amount used can be small, it is more preferable to use a reaction initiator having high hydrogen abstraction ability, and a radical reaction initiator having high hydrogen abstraction ability such as t-butyl peroxyisopropyl monocarbonate, benzoyl peroxide, di-t-butyl peroxide, t-butylcumyl peroxide, dicumyl peroxide, α,α-bis(t-butylperoxy)diisopropylbenzene, 2,5-dimethyl-2,5-bis(t-butylperoxy)hexane, di-t-hexyl peroxide, and the like is particularly preferable.

The amount of the radical reaction initiator used is not particularly limited, but the preferred amount is from 0.1 parts by mass to 10.0 parts by mass with respect to 100.0 parts by mass of the vinyl resin and the polyester resin having carbon-carbon double bonds, which are to be mixed, based on the unsaturated carboxylic acid component and unsaturated alcohol component contained in the constituent components of the polyester resin having carbon-carbon double bonds.

When the amount of radical reaction initiator used is 0.1 parts by mass or more, the crosslinking reaction tends to proceed easily, and when the amount is 10.0 parts by mass or less, the odor tends to be satisfactory. The amount used is more preferably from 0.3 parts by mass to 8.0 parts by mass, and further preferably from 0.5 parts by mass to 5.0 parts by mass.

The amount of the carbon-carbon double bonds in the toner is not particularly limited, but is preferably 0.50 mmol/g or less, more preferably 0.40 mmol/g or less, and further preferably 0.30 mmol/g or less based on the mass of the toner.

In the case of the above range, the charge leakage of the toner is reduced and charging performance is stabilized.

The lower limit is not particularly limited, but is preferably 0.10 mmol/g or more, and more preferably 0.20 mmol/g or more.

The crystalline segment is preferably a vinyl resin part having crystallinity. The vinyl resin segment having crystallinity is preferably a polymer $A_1$ segment which is a polymer of a monomer including a polymerizable monomer A. The polymerizable monomer $A_1$ is a (meth)acrylate having a chain hydrocarbon group having from 18 to 36 carbon atoms. The mass ratio of the polymerizable monomer $A_1$ unit in the polymer $A_1$ segment is preferably from 30% by mass to 99% by mass.

Where the mass ratio is 30 mass % or more, the low-temperature fixability is improved, and where the mass ratio is 99 mass % or less, the hot offset resistance is improved. Further, from the viewpoint of achieving low-temperature fixability in combination with hot offset resistance and heat-resistant storage stability, the mass ratio is more preferably from 50% by mass to 98% by mass, further preferably from 55% by mass to 97% by mass, and even more preferably from 60% by mass to 95 mass %.

Where the number of carbon atoms in the chain hydrocarbon group of the polymerizable monomer $A_1$ is 18 or more, the melting point of the crystalline segment is increased and the heat-resistant storage stability of the toner is improved. When the number of carbon atoms is 36 or less, the melting point is adequate, and the low-temperature fixability is therefore improved.

The amorphous segment is an amorphous modified resin segment in which a vinyl resin having crystallinity and a polyester resin are crosslinked with each other by carbon-carbon bonds, this segment having a segment derived from the vinyl resin having crystallinity and a polyester segment. In the amorphous segment, the segment derived from the vinyl resin having crystallinity is preferably a polymer $A_2$ segment which is a polymer of a monomer including a polymerizable monomer $A_2$. The polymerizable monomer $A_2$ is a (meth)acrylate having a chain hydrocarbon group having from 18 to 36 carbon atoms.

From the viewpoint of facilitating the formation of a block polymer, it is preferable that the vinyl resin segment (that is, the polymer $A_2$ segment) having crystallinity in the modified resin segment (crosslinked polyester resin segment), which is an amorphous segment, and the vinyl resin segment (that is, the polymer $A_1$ segment) having crystallinity in the in the crystalline segment have the same structure. That is, it is preferable that the vinyl resin segment having crystallinity in the modified resin which is the amorphous segment be derived from the polymer $A_1$ which is a polymer of a monomer including the polymerizable monomer $A_1$.

The polymerizable monomer $A_1$ is a (meth)acrylate having a chain hydrocarbon group having from 18 to 36 carbon atoms, and the mass ratio of the polymerizable monomer $A_1$ unit in the polymer $A_1$ segment is preferably from 30% by mass to 99% by mass. Similarly, the mass ratio of the polymerizable monomer $A_2$ unit in the polymer $A_2$ segment is also preferably from 30% by mass to 99% by mass.

Examples of the chain hydrocarbon group having from 18 to 36 carbon atoms include a chain unsaturated hydrocarbon group having from 18 to 36 carbon atoms and a chain saturated hydrocarbon group having from 18 to 36 carbon atoms (hereinafter also referred to as alkyl group). Among the (meth)acrylates having a chain hydrocarbon group having from 18 to 36 carbon atoms, the (meth)acrylate having an alkyl group having from 18 to 36 carbon atoms is preferable.

Examples of the (meth)acrylate having an alkyl group having from 18 to 36 carbon atoms include (meth)acrylates having a linear alkyl group having from 18 to 36 carbon atoms [octadecyl (meth)acrylate, nonadecyl (meth)acrylate, eicosyl (meth)acrylate, heneicosanyl (meth)acrylate, behenyl (meth)acrylate, lignoceryl (meth)acrylate, ceryl (meth) acrylate, montanyl (meth)acrylate, myricyl (meth)acrylate, dodriacontyl (meth)acrylate, and the like] and (meth)acrylates having a branched alkyl group having from 18 to 36 carbon atoms [2-decyltetradecyl (meth)acrylate and the like].

Of these, from the viewpoint of improving the storage stability of the toner, the low-temperature fixability, and the hot offset resistance, a (meth)acrylate having an alkyl group having from 18 to 34 carbon atoms is preferable, and a (meth)acrylate having an alkyl group having from 18 to 30 carbon atoms is more preferable, and at least one selected from the group consisting of stearyl (meth)acrylate, octadecyl (meth)acrylate and behenyl (meth)acrylate is even more preferable.

The polymerizable monomer A (the polymerizable monomer $A_1$ and the polymerizable monomer $A_2$ are collectively referred to as the polymerizable monomer A) may be used alone or in combination of two or more.

The monomer used for the synthesis of the polymer A (the polymer $A_1$ and the polymer $A_2$ are collectively referred to as the polymer A) may include at least one polymerizable monomer B selected from the group consisting of styrene, methyl methacrylate and methyl acrylate, in addition to the polymerizable monomer A.

Among these polymerizable monomers B, styrene is preferable from the viewpoint of low-temperature fixability, heat-resistant storage stability, and pulverizability of the binder resin.

The mass ratio of the polymerizable monomer B unit in the polymer A is preferably from 2% by mass to 35% by mass, and more preferably from 4% by mass to 25% by mass. Further, the mass ratio of the polymerizable monomer B unit in the polymer A segment (the polymer $A_1$ segment and the polymer $A_2$ segment are collectively referred to as the polymer A segment) is also preferably from 2% by mass to 35% by mass, and more preferably from 4% by mass to 25% by mass.

The monomer used for the synthesis of the polymer A may include a polymerizable monomer C in addition to the polymerizable monomer A and the polymerizable monomer B. From the viewpoint of controlling the crystallinity of the crystalline segment to control the heat-resistant storage stability and low-temperature fixability of the toner, it is preferable to include the polymerizable monomer C. Further, by using the polymerizable monomer C as a constituent monomer, it is possible to control the glass transition temperature and elasticity of the amorphous segment, and the hot offset resistance of the toner can be improved.

For example, the following monomers can be used as the polymerizable monomer C. The polymerizable monomer C may be used alone or in combination of two or more.

The mass ratio of the polymerizable monomer C unit in the polymer A is preferably from 2% by mass to 35% by mass, and more preferably from 4% by mass to 25% by mass. The mass ratio of the polymerizable monomer C unit in the polymer A segment is also preferably from 2% by mass to 35% by mass, and more preferably from 4% by mass to 25% by mass.

Monomers having a nitrile group: for example, acrylonitrile, methacrylonitrile, and the like.

Monomers having a hydroxyl group: for example, 2-hydroxyethyl (meth)acrylate, 2-hydroxypropyl (meth)acrylate, and the like.

Monomers having an amide group: for example, acrylamide and monomers obtained by reacting an amine having from 1 to 30 carbon atoms and a carboxylic acid having an ethylenically unsaturated bond and having from 2 to 30 carbon atoms (acrylic acid, methacrylic acid, and the like) by a known method.

Monomers having an urethane group: for example, monomers obtained by reacting an alcohol having an ethylenically unsaturated bond and having from 2 to 22 carbon atoms (2-hydroxyethyl methacrylate, vinyl alcohol, and the like) and an isocyanate having from 1 to 30 carbon atoms [monoisocyanate compound (benzenesulfonyl isocyanate, tosyl isocyanate, phenyl isocyanate, p-chlorophenyl isocyanate, butyl isocyanate, hexyl isocyanate, t-butyl isocyanate, cyclohexyl isocyanate, octyl isocyanate, 2-ethylhexyl isocyanate, dodecyl isocyanate, adamantyl isocyanate, 2,6-dimethylphenyl isocyanate, 3,5-dimethylphenyl isocyanate, 2,6-dipropylphenyl isocyanate, and the like), an aliphatic diisocyanate compound (trimethylene diisocyanate, tetramethylene diisocyanate, hexamethylene diisocyanate, pentamethylene diisocyanate, 1,2-propylene diisocyanate, 1,3-butylene diisocyanate, dodecamethylene diisocyanate, 2,4,4-trimethylhexamethylene diisocyanate, and the like), an alicyclic diisocyanate compound (1,3-cyclopentene diisocyanate, 1,3-cyclohexane diisocyanate, 1,4-cyclohexane diisocyanate, isophorone diisocyanate, hydrogenated diphenylmethane diisocyanate, hydrogenated xylylene diisocyanate, hydrogenated tolylene diisocyanate, hydrogenated tetramethyl xylylene diisocyanate, and the like, and an aromatic diisocyanate compound (phenylene diisocyanate, 2,4-tolylene diisocyanate, 2,6-tolylene diisocyanate, 2,2'-diphenylmethane diisocyanate, 4,4'-diphenylmethane diisocyanate, 4,4'-toluidine diisocyanate, 4,4'-diphenyl ether diisocyanate, 4,4'-diphenyl diisocyanate, 1,5-naphthalene diisocyanate, xylylene diisocyanate, and the like) and the like] by a known method, monomers obtained by reacting an alcohol having from 1 to 26 carbon atoms (methanol, ethanol, propanol, isopropyl alcohol, butanol, t-butyl alcohol, pentanol, heptanol, octanol, 2-ethylhexanol, nonanol, decanol, undecyl alcohol, lauryl alcohol, dodecyl alcohol, myristyl alcohol, pentadecyl alcohol, cetanol, heptadecanol, stearyl alcohol, isostearyl alcohol, elaidyl alcohol, oleyl alcohol, linoleyl alcohol, linolenyl alcohol, nonadecyl alcohol, heneicosanol, behenyl alcohol, erucyl alcohol, and the like) and an isocyanate having an ethylenically unsaturated bond and having from 2 to 30 carbon atoms [2-isocyanatoethyl (meth)acrylate, 2-(0-[1'-methylpropylideneamino]carboxamino)ethyl (meth)acrylate, 2-[(3,5-dimethylpyrazolyl) carbonylamino]ethyl (meth)acrylate, 1,1-(bis (meth) acryloyloxymethyl) ethylisocyanate, and the like] by a known method, and the like.

Monomers having a urea group: for example, monomers obtained by reacting an amine having from 3 to 22 carbon atoms [primary amines (normal butylamine, t-butylamine, propylamine, isopropylamine, and the like), secondary amines (dinormal ethylamine, dinormal propylamine, dinormal butylamine, and the like), aniline, cycloxylamine, and the like] and an isocyanate having an ethylenically unsaturated bond and having from 2 to 30 carbon atoms by a known method.

Monomers having a carboxy group: for example, methacrylic acid, acrylic acid, and 2-carboxyethyl (meth)acrylate.

Among them, it is preferable to use a monomer having a nitrile group, an amide group, a urethane group, a hydroxyl group, or a urea group. More preferred is a monomer having an ethylenically unsaturated bond and at least one functional group selected from the group consisting of a nitrile group, an amide group, a urethane group, a hydroxyl group, and a urea group. Particularly preferred is at least one selected from the group consisting of acrylonitrile and methacrylonitrile.

Further, as the polymerizable monomer C, vinyl esters such as vinyl acetate, vinyl propionate, vinyl butyrate, vinyl caproate, vinyl caprylate, vinyl caprate, vinyl laurate, vinyl myristate, vinyl palmitate, vinyl stearate, vinyl pivalate, and vinyl octylate are also preferably used.

Vinyl esters are non-conjugated monomers, and the reactivity with the first polymerizable monomer is easily maintained at an appropriate level, so that the crystallinity of the crystalline segment of the polymer A is easily improved and it becomes easier to achieve both the low-temperature fixability and the heat-resistant storage stability.

Examples of the polymerizable monomer C can also include at least one selected from the group consisting of the following formulas (A) and (B).

(A)

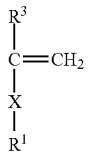

(B)

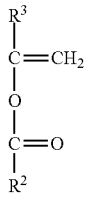

In the formulas, X represents a single bond or an alkylene group having from 1 to 6 carbon atoms, $R^1$ is a nitrile group (—C≡N), an amide group (—C(=O)NHR$^{10}$ ($R^{10}$ is a hydrogen atom or an alkyl group having from 1 to 4 carbon atoms)), a hydroxyl group, —COOR$^{11}$ ($R^{11}$ is an alkyl group having from 1 to 6 (preferably from 1 to 4) carbon atoms or a hydroxyalkyl group having from 1 to 6 (preferably from 1 to 4) carbon atoms), a urethane group (—NHCOOR$^{12}$ ($R^{12}$ is an alkyl group having from 1 to 4 carbon atoms)), a urea group (—NH—C(=O)—N($R^{13}$)$_2$ ($R^{13}$ is independently a hydrogen atom or an alkyl group having from 1 to 6 (preferably from 1 to 4) carbon atoms)), —COO($CH_2$)$_2$NHCOOR$^{14}$ ($R^{14}$ is an alkyl group having from 1 to 4 carbon atoms), or —COO($CH_2$)$_2$—NH—C(=O)—N($R^{15}$)$_2$ ($R^{15}$ is independently a hydrogen atom or an alkyl group having from 1 to 6 (preferably from 1 to 4) carbon atoms), and $R^2$ is an alkyl group having from 1 to 4 carbon atoms, and $R^3$ is independently a hydrogen atom or a methyl group.

The vinyl resin having crystallinity can be preferably produced by polymerizing a monomer composition including polymerizable monomers A, B and C. For example, the vinyl resin can be synthesized by a solution polymerization method in which the polymerizable monomers are reacted with a radical reaction initiator in a solvent (toluene or the like).

When the vinyl resin having crystallinity contains a THF-insoluble matter, the amount of the THF-insoluble matter is preferably 1.0% by mass or less, and more preferably from 0.1% by mass to 1.0% by mass.

In addition, from the viewpoint of low-temperature fixability, it is preferable that the vinyl resin having crystallinity does not contain a THF-insoluble matter.

From the viewpoint of achieving both heat-resistant storage stability and low-temperature fixability of the toner, the number average molecular weight Mn of the THF-soluble matter of the crystalline vinyl resin is preferably from 1000 to 300,000, more preferably from 3000 to 50,000, and even more preferably from 5000 to 20,000.

The weight average molecular weight Mw is preferably from 10,000 to 500,000, more preferably from 20,000 to 100,000, and further preferably from 40,000 to 80,000.

The crosslinked polyester resin is a modified resin having a structure in which a vinyl resin having crystallinity and a polyester resin are crosslinked by carbon-carbon bonds. The crosslinked polyester resin also has a structure in which a polyester resin is crosslinked by carbon-carbon bonds. The carbon-carbon bond means that at least one bond forming a crosslinked structure is a direct bond between a carbon atom and a carbon atom.

The polyester resin mentioned herein is not particularly limited as long as crosslinking by carbon-carbon bonds can be made. Among such resins, from the viewpoint of easily forming the crosslinked structure, a polyester resin having carbon-carbon double bonds is preferable.

Further, it is preferable that at least some of the carbon-carbon bonds of the crosslinked polyester resin be carbon-carbon bonds in which carbon-carbon double bonds derived from a polyester resin having carbon-carbon double bonds are crosslinked.

The cross-linked polyester resin is obtained by reacting carbon-carbon double bonds of the polyester resin having carbon-carbon double bonds. The crosslinked polyester resin can also be obtained by a method of crosslinking by abstracting hydrogen atoms bonded to carbon atoms contained in the polyester resin having carbon-carbon double bonds by a hydrogen abstraction reaction induced heating or the like.

Here, the crosslinked polyester resin is a polyester resin having a branch (crosslinking point) in the main chain. Specifically, it refers to a polyester resin obtained by a crosslinking reaction, and examples of the form of the crosslinking reaction include the following.

A cross-linking reaction generating a carbon-carbon bond (a reaction by which an unsaturated double bond is introduced into a main chain or a side chain of a polyester resin, the unsaturated double bond is reacted by a radical addition reaction, a cation addition reaction, an anion addition reaction, or the like, and an intermolecular carbon-carbon bond is generated; a reaction generating an intermolecular carbon-carbon bond by a hydrogen atom abstraction reaction using a peroxide or the like; or the like); a reaction generating crosslinking by an ester bond by performing a condensation reaction using a trifunctional or higher functional polycarboxylic acid and a trifunctional or higher polyol; a polyaddition reaction of a compound including a polyvalent epoxy group, a polyvalent isocyanate group, a polyvalent carbodiimide group, a polyvalent aziridine group, a polyvalent oxazoline group, or the like, with a polyester resin; and the like.

Further, the crosslinked polyester resin may have a crosslink by carbon-carbon bonds, and may have a crosslink by an ester bond, a crosslink by a polyaddition reaction, and the like. Further, the crosslinked polyester resin may be composed of one crosslinked polyester resin, or may be a mixture of two or more crosslinked polyester resins.

A crosslinked polyester resin that forms a network by branching does not usually dissolve in THF. Therefore, the nonlinearity of a crosslinked polyester resin can be confirmed by whether the crosslinked polyester resin is dissolved in THE and has a component insoluble in TH (THF-insoluble matter).

Further, in the toner, the polyester resin having carbon-carbon double bonds is preferably a polycondensate of a carboxylic acid component and an alcohol component having at least one of an unsaturated carboxylic acid component and an unsaturated alcohol component.

The monomers used for the polyester resin having carbon-carbon double bonds may include a saturated alcohol component or a saturated carboxylic acid component as a constituent component in addition to the unsaturated carboxylic acid component or the unsaturated alcohol component.

Also, the polyester resin having carbon-carbon double bonds may be polycondensed using one type of each component, or may be polycondensed using multiple types of each component together.

The amount of the carbon-carbon double bonds in the polyester resin having carbon-carbon double bonds is not particularly limited, but is preferably from 0.02 mmol/g to 0.80 mmol/g, and more preferably from 0.20 mmol/g to 0.70 mmol/g.

In the case of the above range, a crosslinking reaction suitably occurs and block polymerization progresses appropriately, so that the low-temperature fixability and hot offset resistance of the toner are improved and the fixing temperature range is expanded. In addition, the charge leakage of the toner is reduced and the charging performance is stabilized.

Note that the bond of an aromatic ring is not considered in determining whether the component is an unsaturated carboxylic acid component or a saturated carboxylic acid component. That is, a compound in which a portion other than the aromatic ring is an unsaturated carboxylic acid is determined to be an unsaturated carboxylic acid component, and a compound in which a portion other than the aromatic ring is a saturated carboxylic acid is determined to be a saturated carboxylic acid component.

Similarly, the bond of the aromatic ring is not considered in determining whether the component is an unsaturated alcohol component or a saturated alcohol component. That is, a compound in which a portion other than the aromatic ring is an unsaturated alcohol is determined to be an unsaturated alcohol component, and a compound in which a portion other than the aromatic ring is a saturated alcohol is determined to be a saturated alcohol component.

The peak top molecular weight Mp of the crosslinked polyester resin is preferably from 2000 to 30,000, more preferably from 3000 to 20,000, and further preferably from 4000 to 12,000. When the peak top molecular weight Mp is in the above range, the glossiness, low-temperature fixability and hot offset resistance are improved.

From the viewpoint of charge stability, the acid value of the crosslinked polyester resin is preferably from 0 mg KOH/g to 30 mg KOH/g, more preferably from 0 mg KOH/g to 25 mg KOH/g, further preferably from 0 mg KOH/g to 10 mg KOH/g, and particularly preferably from 0.1 mg KOH/g to 10 mg KOH/g.

Further, a method for producing the polyester resin having carbon-carbon double bonds is not particularly limited. As described above, a polyester resin obtained by polycondensing constituent components including one or more kinds of unsaturated carboxylic acid component and/or unsaturated alcohol component is preferred.

Furthermore, examples of methods that can be used when the polyester is non-linear include a method of using a trivalent or higher polyol that is a saturated alcohol component as a constituent component in addition to the unsaturated carboxylic acid component and/or the unsaturated alcohol component, and a method of using a trivalent or higher carboxylic acid, or an acid anhydride thereof, or a lower alkyl ester thereof that is a saturated carboxylic acid component in addition to the unsaturated carboxylic acid component and/or the unsaturated alcohol component.

For example, the constituent components can be reacted in an atmosphere of an inactive gas (nitrogen gas or the like) at a reaction temperature of preferably from 150° C. to 280° C., more preferably from 160° C. to 250° C., still more preferably from 170° C. to 235° C. From the viewpoint of reliably conducting the polycondensation reaction, the reaction time is preferably 30 minutes or more, and more preferably from 2 hours to 40 hours.

Furthermore, an esterification catalyst can be used if necessary.

Examples of esterification catalysts include tin-containing catalysts (for example, dibutyltin oxide and the like), antimony dioxide, titanium-containing catalysts (for example, titanium alkoxides, potassium oxalate titanate, titanium terephthalate, titanium terephthalate alkoxides, titanium dihydroxybis(triethanol aminate), titanium monohydroxytris(triethanol aminate), titanyl-bis(triethanol aminate), intramolecular polycondensates thereof, and the like, titanium tributoxyterephthalate, titanium triisopropoxyterephthalate, titanium diisopropoxyditerephthalate, and the like), zirconium-containing catalysts (for example, zirconyl acetate and the like), zinc acetate, and the like.

Among these, the titanium-containing catalysts are preferable. It is also effective to reduce the pressure in order to improve the reaction rate in the final stage of the reaction.

Further, a stabilizer may be added for the purpose of achieving polymerization stability. Examples of the stabilizer include hydroquinone, methylhydroquinone, hindered phenol compounds, and the like.

The total charging ratio of the saturated alcohol component, unsaturated alcohol component, unsaturated carboxylic acid component, and saturated carboxylic acid component to be used in the reaction is preferably from 2.0/1.0 to 1.0/2.0, more preferably from 1.5/1.0 to 1.0/1.3, and still more preferably from 1.4/1.0 to 1.0/1.2 as an equivalent ratio ([OH]/[COOH]) of hydroxyl groups to carboxyl groups. Further, it is sufficient to include one or both of the unsaturated carboxylic acid component and the unsaturated alcohol component.

Examples of the unsaturated alcohol component include monools, diols, and the like.

Examples of the monools include unsaturated monools having from 2 to 30 carbon atoms, and preferable examples include 2-propen-1-ol, oleyl alcohol, 2-hydroxyethyl methacrylate, and the like. Examples of the diols include unsaturated diols having from 2 to 30 carbon atoms, and ricinoleyl alcohol is a preferable example.

Examples of the saturated alcohol component include monools, diols, polyols having from 3 to 8 or more hydroxyl groups, and the like. These may be used alone or in combination of two or more.

Examples of monools include alkanols having from 1 to 30 carbon atoms (methanol, ethanol, isopropanol, dodecyl alcohol, myristyl alcohol, cetyl alcohol, stearyl alcohol, behenyl alcohol, and the like) and the like.

Among these monools, preferred are alkanols having from 8 to 24 carbon atoms, and more preferred are dodecyl alcohol, myristyl alcohol, stearyl alcohol, and behenyl alcohol.

Examples of the diols include alkylene glycols having from 2 to 36 carbon atoms (ethylene glycol, 1,2-propylene glycol, 1,3-propylene glycol, 1,4-butanediol, neopentyl glycol, 1,6-hexanediol, 1, 9-nonanediol, 1,10-decanediol, 1,12-dodecanediol, and the like); alkylene ether glycols having from 4 to 86 carbon atoms (diethylene glycol, triethylene glycol, dipropylene glycol, polyethylene glycol, polypropylene glycol, polytetramethylene ether glycol, and the like); alicyclic diols having from 6 to 36 carbon atoms (1,4-cyclohexanedimethanol, hydrogenated bisphenol A, and the like), (poly)oxyalkylene [the number of carbon atoms in the alkylene group is from 2 to 4 (oxyethylene, oxypropylene, and the like), the same also applies to the following polyoxyalkylene groups] ethers [the number of alkylene oxide units is from 1 to 30] of the alicyclic diols; divalent phenols [monocyclic divalent phenols (for example, hydroquinone)], polyoxyalkylene ethers (the number of alkylene oxide units is from 2 to 30) of bisphenols, and the like.

Among these diols, from the viewpoints of low-temperature fixability and heat-resistant storage stability, alkylene glycols having from 2 to 36 carbon atoms and polyoxyalkylene ethers of bisphenols are preferable, and polyoxyalkylene ethers of bisphenols are more preferable. The polyoxyalkylene ether of bisphenol is obtained by adding an alkylene oxide to bisphenol. Examples of the bisphenols include those represented by the following formula (5).

$$HO—Ar—X—Ar—OH \quad (5)$$

In the formula, X represents an alkylene group having from 1 to 3 carbon atoms, $—SO_2—$, —O—, —S—, or a direct bond, and Ar each independently represent an unsubstituted phenylene group or a phenylene group having a substituent, and have a halogen atom or an alkyl group having from 1 to 30 carbon atoms as a substituent.

Examples of the bisphenol include bisphenol A, bisphenol F, bisphenol B, bisphenol AD, bisphenol S, trichlorobisphenol A, tetrachlorobisphenol A, dibromobisphenol F, 2-methylbisphenol A, 2,6-dimethylbisphenol A, 2,2'-diethylbisphenol F, and the like, and these may be used in combination of two or more.

The alkylene oxide added to these bisphenols is preferably an alkylene oxide having from 2 to 4 carbon atoms, and specifically, ethylene oxide, propylene oxide (meaning "1,2-propylene oxide"), 1,2-, 2,3-, 1,3- or iso-butylene oxide, tetrahydrofuran, combinations of two or more thereof, and the like.

Among these, ethylene oxide and propylene oxide are preferable. The number of moles of alkylene oxide added is preferably from 2 to 30 moles, and more preferably from 2 to 10 moles.

Among the polyoxyalkylene ethers of bisphenols, from the viewpoints of toner fixing performance, pulverizability and heat-resistant storage stability, ethylene oxide adducts and propylene oxide adducts of bisphenol A (average addition mole number from 2 to 4, preferably 2 or 3) are preferred.

Examples of the polyols having from 3 to 8 or more hydroxyl groups include aliphatic polyhydric alcohols having from 3 to 8 or more hydroxyl groups and having from 3 to 36 carbon atoms, saccharides and derivatives thereof, (poly)oxyalkylene ethers (the number of alkylene oxide units is from 1 to 30) of aliphatic polyhydric alcohols, polyoxyalkylene ethers (the number of alkylene oxide units is from 2 to 80) of trisphenols (trisphenol PA and the like), polyoxyalkylene ethers (the number of alkylene oxide units is from 2 to 30) of novolac resins (phenol novolac, cresol novolac, and the like; average degree of polymerization is from 3 to 60), and the like.

Examples of the aliphatic polyhydric alcohols having from 3 to 8 or more hydroxyl groups and having from 3 to 86 carbon atoms include alkane polyols and intramolecular or intermolecular dehydrated products thereof, and more specifically, glycerin, trimethylolethane, trimethylolpropane, pentaerythritol, sorbitol, sorbitan, polyglycerin, dipentaerythritol, and the like.

Specific examples of the sugar and derivatives thereof include sucrose, methyl glucoside, and the like.

Among polyols having from 3 to 8 or more hydroxyl groups, from the viewpoint of achieving both low-temperature fixability and hot offset resistance, aliphatic polyhydric alcohols having from 3 to 8 or more hydroxyl groups and having from 3 to 36 carbon atoms and polyoxyalkylene ethers (the number of alkylene oxide units is from 2 to 30) of novolac resins (phenol novolac, cresol novolac, and the like) are preferable.

Among the saturated alcohol components, from the viewpoint of improving low-temperature fixability, hot offset resistance and heat-resistant storage stability, alkylene diols having from 2 to 36 carbon atoms, polyoxyalkylene ethers (the number of alkylene oxide units is from 2 to 30) of bisphenols, aliphatic polyhydric alcohols having from 3 to 36 carbon atoms and from 3 to 8 or more hydroxyl groups, and polyoxyalkylene ethers (the number of alkylene oxide units is from 2 to 30) of novolac resins are preferable.

From the viewpoint of heat-resistant storage stability, more preferred saturated alcohol components are alkylene glycols having from 2 to 10 carbon atoms, polyoxyalkylene ethers (having from 2 to 5 alkylene oxide units) of bisphenols, aliphatic polyhydric alcohols having from 3 to 8 or more hydroxyl groups, and polyoxyalkylene ethers (the number of alkylene oxide units is from 2 to 30) of novolac resins.

Particularly preferred are alkylene glycols having from 2 to 6 carbon atoms, polyoxyalkylene ethers (the number of alkylene oxide units is from 2 to 5) of bisphenol A, and trihydric aliphatic polyhydric alcohols. Most preferred are ethylene glycol, propylene glycol, polyoxyalkylene ethers of bisphenol A (the number of alkylene oxide units is 2 or 3), and trimethylolpropane.

Examples of the unsaturated carboxylic acid components include unsaturated monocarboxylic acids, unsaturated dicarboxylic acids, unsaturated polycarboxylic acids, anhydrides and lower alkyl esters of these acids, and the like.

The unsaturated monocarboxylic acids include unsaturated monocarboxylic acids having from 2 to 80 carbon atoms, and specifically, acrylic acid, methacrylic acid, propiolic acid, 2-butenoic acid, crotonic acid, isocrotonic acid, 3-butenoic acid, anglicic acid, tiglic acid, 4-pentenoic acid, 2-ethyl-2-butenoic acid, 10-undecenoic acid, 2,4-hexadienoic acid, myristoleic acid, palmitoleic acid, sapienoic acid, oleic acid, elaidic acid, vaccenic acid, gadoleic acid, erucic acid, nervonic acid, and the like.

The unsaturated dicarboxylic acids include an alkene dicarboxylic acid having from 4 to 50 carbon atoms, and specifically, alkenylsuccinic acids such as dodecenylsuccinic acid and the like, maleic acid, fumaric acid, citraconic acid, mesaconic acid, itaconic acid, glutaconic acid, and the like.

Examples of unsaturated polycarboxylic acids include vinyl polymers of unsaturated carboxylic acids (having a number average molecular weight Mn of from 450 to 10,000 as determined by gel permeation chromatography (GPC)).

Among these unsaturated carboxylic acids, from the viewpoint of achieving both low-temperature fixability and hot offset resistance, acrylic acid, methacrylic acid, alkenylsuccinic acids such as dodecenyl succinic acid and the like, maleic acid, and fumaric acid are preferred. More preferred are acrylic acid, methacrylic acid, maleic acid, fumaric acid and combinations thereof. Further, the unsaturated carboxylic acid may be an anhydride or a lower alkyl ester of these acids.

Examples of the saturated carboxylic acid component include aliphatic carboxylic acids having from 2 to 50 carbon atoms (stearic acid, behenic acid, and the like), aromatic carboxylic acids having from 7 to 37 carbon atoms (benzoic acid and the like), alkanedicarboxylic acids having from 2 to 50 carbon atoms (oxalic acid, malonic acid, succinic acid, adipic acid, leparginic acid, sebacic acid, and the like), aromatic dicarboxylic acids having from 8 to 86 carbon atoms (phthalic acid, isophthalic acid, terephthalic acid, naphthalenedicarboxylic acid, and the like), aromatic polycarboxylic acids having from 9 to 20 carbon atoms (trimellitic acid, pyromellitic acid, and the like), aliphatic tricarboxylic acids having from 6 to 36 carbon atoms (hexane tricarboxylic acid and the like), and the like.

Further, the saturated carboxylic acid component may be an anhydride or a lower alkyl (from 1 to 4 carbon atoms) ester (methyl ester, ethyl ester, isopropyl ester, and the like) of any of these carboxylic acids.

Among these saturated carboxylic acid components, from the viewpoints of achieving low-temperature fixability, hot offset resistance and heat-resistant storage stability, aromatic carboxylic acids having from 7 to 87 carbon atoms, alkanedicarboxylic acids having from 2 to 50 carbon atoms, aromatic dicarboxylic acids having from 8 to 20 carbon atoms, and aromatic polycarboxylic acids having from 9 to 20 carbon atoms are preferable.

From the viewpoints of heat-resistant storage stability and charging performance, benzoic acid, adipic acid, alkylsuccinic acid, terephthalic acid, isophthalic acid, trimellitic acid, pyromellitic acid, and combinations thereof are more preferable.

Particularly preferred are adipic acid, terephthalic acid, trimellitic acid and combinations thereof. Further, anhydrides or lower alkyl esters of these acids may also be used.

The glass transition temperature (Tg) of the THF-insoluble matter of the resin component of the toner is preferably from 25° C. to 55° C., and more preferably from 30° C. to 53° C. When the Tg is 25° C. or higher, the heat-resistant storage stability of the toner is improved. When the Tg is 55° C. or less, the amorphous segment is easily plasticized in the fixing step, and the low-temperature fixability is improved.

In the temperature rise measurement of a toner with a constant-load extrusion-type rheometer, the softening point (½ outflow temperature) is preferably from 80° C. to 130° C., and more preferably from 85° C. to 128° C. When the softening point is 80° C. or higher, the hot offset resistance becomes satisfactory. When the temperature is 130° C. or lower, the low-temperature fixability is significantly improved.

Further, in the viscoelasticity measurement of the tetrahydrofuran-soluble matter of the toner, it is preferable that the storage elastic modulus Gk'(50) at 50° C. satisfies the following formula (6).

$$G'(50) \geq 1.0\times10^{7}\ \text{Pa} \tag{6}$$

G'(50) is more preferably $1.5\times10^{7}$ Pa or more, and further preferably $2.0\times10^{7}$ Pa or more. The upper limit is not particularly limited, but is preferably $1.0\times10^{10}$ Pa or less.

Where G'(50) is in this range, the melting point and glass transition point of the toner are sufficient, and the storage stability is satisfactory. G'(50) can be controlled by the molecular weight of the binder resin.

Further, in the viscoelasticity measurement of the tetrahydrofuran-soluble matter of the toner, it is preferable that the storage elastic modulus G'(100) at 100° C. satisfies the following formula (7).

$$G'(100) \leq 1.0\times10^{6}\ \text{Pa} \tag{7}$$

G'(100) is more preferably $0.9\times10^{6}$ Pa or less, and further preferably $0.8\times10^{6}$ Pa or less. The lower limit is not particularly limited, but is preferably $1.0\times10^{3}$ Pa or more.

Higher toner storage modulus at high temperature can suppress density unevenness at the time of fixing. Therefore, in the viscoelasticity measurement of the tetrahydrofuran-soluble matter of the toner, it is preferable that the storage elastic modulus G'(150) at 150° C. is preferably from $1.0\times10^{4}$ Pa to $1.0\times10^{7}$ Pa.

The storage elastic modulus value at 150° C. is more preferably $0.8\times10^{5}$ Pa or more, and further preferably $1.0\times10^{5}$ Pa or more. The upper limit is not particularly limited, but is preferably $1.0\times10^{7}$ Pa or less, and more preferably $1.0\times10^{6}$ Pa or less. This value can be controlled by the molecular weight of the binder resin, the THF-insoluble matter ratio, and Tg.

When the toner receives heat sufficient to melt the toner from the outside, the viscoelasticity of the toner decreases, but the storage elastic modulus remaining at a constant value at high temperature is supposed to mean that a highly elastic substance that becomes the THF-insoluble matter in the toner maintains a constant viscoelasticity of the entire toner.

In addition to the binder resin, the toner may optionally include one or more known additives selected from colorants, release agents, charge control agents, fluidizing agents, and the like. Materials other than the binder resin used for the toner particles will be specifically described hereinbelow.

The toner may include a release agent in order to impart releasability at the time of fixing. Examples of the release agent include polyolefin copolymers, polyolefin waxes, microcrystalline waxes, paraffin waxes, aliphatic hydrocarbon waxes such as Fischer-Tropsch wax, ester waxes, and the like.

The molecular weight of the release agent is preferably 1000 or more. Where the molecular weight is 1000 or more, the compatibility with the crystalline segment is reduced and the phases are separated. As a result, the release agent is likely to out-migrate to the surface of the toner particles at the time of fixing, thereby improving the releasability. Further, since the crystalline segment and the release agent are unlikely to be compatible with each other, the crystallinity of the crystalline segment is improved and the melting point is increased, so that the heat-resistant storage stability is improved.

Here, the molecular weight of the release agent refers to the peak molecular weight (Mp) in gel permeation chromatography (GPC) measurement. The measurement method will be described later.

The molecular weight of the release agent is preferably 1500 or more. The upper limit is not particularly limited, but from the viewpoint of ensuring releasability, the molecular weight is preferably 10,000 or less, and more preferably 5000 or less.

The release agent is not particularly limited as long as the molecular weight is 1000 or more, and examples thereof include the following.

Aliphatic hydrocarbon waxes: low-molecular-weight polyethylene, low-molecular-weight polypropylene, low-molecular-weight olefin copolymers, Fischer-Tropsch waxes, or waxes obtained by oxidation thereof and addition of an acid thereto.

Further, an ester wax including a fatty acid ester as a main component can also be used. From the viewpoint of molecular weight, the ester wax is preferably a trifunctional or higher functional ester wax, and more preferably a tetrafunctional or higher functional ester wax.

The trifunctional or higher functional ester wax is obtained, for example, by condensing a trifunctional or higher functional acid with a long-chain linear saturated alcohol, or by synthesizing a trifunctional or higher functional alcohol and a long-chain linear saturated fatty acid.

Examples of trifunctional or higher alcohols that can be used in the ester wax include the following, but are not limited thereto. A plurality of ester waxes can be mixed and used.

Glycerin, trimethylolpropane, erythritol, pentaerythritol, sorbitol. Further, as condensates thereof, so-called polyglycerins such as diglycerin, triglycerin, tetraglycerin, hexaglycerin, decaglycerin, and the like obtained by condensation of glycerin, ditrimethylolpropane and tristrimethylolpropane obtained by condensation of trimethylolpropane, dipentaerythritol and trispentaerythritol obtained by condensation of pentaerythritol, and the like.

Among these, a structure having a branched structure is preferable, pentaerythritol or dipentaerythritol is more preferable, and dipentaerythritol is particularly preferable.

The long-chain linear saturated fatty acid is represented by a general formula $C_nH_{2n+1}COOH$, and acids with n from 5 to 28 are preferably used.

The following examples can be mentioned, but these examples are not limiting. In some cases, the acids can be used as a mixture. Caproic acid, caprylic acid, octylic acid, nonylic acid, decanoic acid, dodecanoic acid, lauric acid, tridecanoic acid, myristic acid, palmitic acid, stearic acid and behenic acid. From the viewpoint of the melting point of wax, myristic acid, palmitic acid, stearic acid, and behenic acid are preferable.

Examples of trifunctional or higher functional acids include trimellitic acid and butanetetracarboxylic acid, but these examples are not limiting. In some cases, the acids can be used as a mixture.

The long-chain linear saturated alcohol is represented by $C_nH_{2n+1}OH$, and alcohols with n from 5 to 28 are preferably used.

The following examples can be mentioned, but these examples are not limiting. In some cases, the alcohols can be used as a mixture. Capryl alcohol, lauryl alcohol, myristyl alcohol, palmityl alcohol, stearyl alcohol and behenyl alcohol. From the viewpoint of the melting point of the wax, myristyl alcohol, palmityl alcohol, stearyl alcohol and behenyl alcohol are preferable.

Release agents having a softening point of from 50° C. to 170° C. as determined by a flow tester are preferable, and examples thereof include polyolefin waxes, natural waxes, aliphatic alcohols having from 30 to 50 carbon atoms, fatty acids having from 30 to 50 carbon atoms, mixtures thereof, and the like.

Examples of the polyolefin waxes include (co)polymers [including those obtained by (co)polymerization and heat-reduced polyolefins] of olefins (for example, ethylene, propylene, 1-butene, isobutylene, 1-hexene, 1-dodecene, 1-octadecene, mixtures thereof, and the like), oxides of olefin (co)polymers obtained using oxygen and/or ozone, maleic acid modification products of olefin (co)polymers [for example, products obtained by modification with maleic acid and derivatives thereof (maleic anhydride, monomethyl maleate, monobutyl maleate, dimethyl maleate, and the like)], copolymers of olefins and unsaturated carboxylic acids [(meth)acrylic acid, itaconic acid, maleic anhydride, and the like] and/or unsaturated carboxylic acid alkyl esters [(meth)acrylic acid alkyl (alkyl having from 1 to 18 carbon atoms) esters, maleic acid alkyl (alkyl having from 1 to 18 carbon atoms), and the like], sasol waxes, and the like.

Examples of natural waxes include carnauba wax, montan wax, paraffin waxes and rice wax. Triacontanol is an example of the aliphatic alcohol having from 30 to 50 carbon atoms. Triacontanecarboxylic acid is an example of the fatty acid having from 30 to 50 carbon atoms.

The release agent preferably includes an aliphatic hydrocarbon wax, and more preferably is an aliphatic hydrocarbon wax. Since the aliphatic hydrocarbon wax has low polarity, such wax easily out-migrates from the polymer A at the time of fixing.

The amount of the release agent in the toner particle is preferably from 1.0% by mass to 30.0% by mass, and more preferably from 2.0% by mass to 25.0% by mass. When the amount of the release agent in the toner particle is within the above range, the releasability at the time of fixing is easily ensured. When the amount is 1.0% by mass or more, the releasability of the toner becomes satisfactory. When the amount is 30.0 mass % or less, the release agent is less likely to be exposed on the surface of the toner particle, and the heat-resistant storage stability becomes satisfactory.

The melting point of the release agent is preferably from 80° C. to 120° C. When the melting point of the release agent is within the above range, the release agent is easily melted at the time of fixing and out-migrates onto the surface of the toner particle, and the releasability is easily exhibited. The melting point is more preferably from 85° C. to 110° C. Where the melting point is 80° C. or higher, the release agent is less likely to be exposed on the surface of the toner particle, and heat-resistant storage stability becomes satisfactory. Meanwhile, when the melting point is 120° C. or lower, the release agent is appropriately melted at the time of fixing, and the low-temperature fixability and the offset resistance are improved.

The acid value of the release agent is preferably from 5.0 mg KOH/g to 20.0 mg KOH/g. Where the acid value is 5.0 mg KOH/g or more, the polarity of the release agent is high, so that the affinity for the long-chain alkyl group in the crystalline segment is decreased, phase separation of the release agent easily occurs, and the releasability is improved. Further, when the acid value of the release agent is 20.0 mg KOH/g or less, the polarity is appropriate and the release agent is easily wetted with air, thereby facilitating the exposure on the surface of the toner particle at the time of melting and improving the releasability.

Where the acid value of the release agent is denoted by $AV_W$ and the acid value of the amorphous segment of the binder resin is denoted $AV_A$, it is preferable that the following formula (4) be satisfied. By controlling the acid value of the release agent within this range, the dispersibility of the release agent in the amorphous segment of the binder resin is improved, and the releasability of the toner is easily ensured. More preferably, $AV_W-AV_A$ is from about 1 to 29.

$$AV_W>AV_A \quad (4)$$

The toner may include magnetic iron oxide particles and be used as a magnetic toner. In this case, the magnetic iron oxide particles can also serve as a colorant.

Examples of the magnetic iron oxide particles include iron oxides such as magnetite, hematite, and ferrite, metals such as iron, cobalt, and nickel, and alloys of these metals with metals such as aluminum, cobalt, copper, lead, magnesium, tin, zinc, antimony, bismuth, calcium, manganese, titanium, tungsten, and vanadium, and mixtures thereof.

The average particle diameter of these magnetic iron oxide particles is preferably 2 m or less, and more preferably from 0.05 m to 0.5 m. The amount in the toner is preferably from 20 parts by mass to 200 parts by mass, and more preferably from 40 parts by mass to 150 parts by mass with respect to 100 parts by mass of the binder resin.

A colorant may be used in the toner. Examples of colorants are given below.

As a black colorant, for example, carbon black, grafted carbon, or colorants toned in black by using the below-described yellow/magenta/cyan colorants can be used.

Examples of yellow colorants include compounds represented by condensed azo compounds, isoindolinone compounds, anthraquinone compounds, azo metal complexes, methine compounds, and allylamide compounds.

Examples of magenta colorants include condensed azo compounds, diketopyrrolopyrrole compounds, anthraquinones, quinacridone compounds, basic dye lake compounds, naphthol compounds, benzimidazolone compounds, thioindigo compounds, perylene compounds, and the like. Examples of cyan colorants include copper phthalocyanine compounds, derivatives thereof, anthraquinone compounds, and basic dye lake compounds.

These colorants can be used alone or in a mixture, and can also be used in a solid solution state. The colorant is selected from the standpoint of hue angle, saturation, lightness, weather resistance, and dispersibility in the toner. The amount of the colorant is preferably from 1 part by mass to 20 parts by mass with respect to 100 parts by mass of the binder resin.

A charge control agent can be used in the toner to stabilize the triboelectric charging performance. Charge control agents that control the toner to demonstrate negative charging performance and those that control the toner to demonstrate positive charging performance are known. One or two or more of various types can be used depending on the type and application of the toner.

The following are examples of the charge control agents that control the toner to demonstrate negative charging performance. Organic metal complexes (monoazo metal complexes; acetylacetone metal complexes); metal complexes or metal salts of aromatic hydroxycarboxylic acids or aromatic dicarboxylic acids. Other examples include aromatic mono- and polycarboxylic acids and their metal salts and anhydrides; esters and phenol derivatives such as bisphenol and the like. The following are examples of the charge control agents that control the toner to demonstrate positive charging performance. Nigrosine and modification products with fatty acid metal salts; quaternary ammonium salts such as tributylbenzylammonium-1-hydroxy-4-naphthosulfonate, tetrabutylammonium tetrafluoroborate, and the like, and derivatives thereof; onium salts such as phosphonium salts and lake pigments thereof; triphenylmethane dyes and lake pigments thereof (examples of laking agents include phosphotungstic acid, phosphomolybdic acid, phosphotungstic molybdic acid, tannic acid, lauric acid, gallic acid, ferricyanic acid, ferrocyanine compounds, and the like); metal salts of higher fatty acids.

Examples of the fluidizing agent include colloidal silica, alumina powder, titanium oxide powder, calcium carbonate powder and the like.

A method for producing the toner particles is not particularly limited, and for example, a pulverization method, and a so-called polymerization method such as an emulsion polymerization method, a suspension polymerization method and a dissolution suspension method can be used.

From the viewpoint of reducing the density unevenness at the time of fixing by maintaining the viscoelasticity at a high temperature, the pulverization method is preferable because it is possible to disperse components insoluble at a high temperature in the entire toner. That is, it is preferable that the toner be a pulverized toner.

In the pulverization method, first, the binder resin constituting the toner particles and, if necessary, additives such as a colorant, a release agent, a charge control agent, and the like are thoroughly mixed with a mixer such as a Henschel mixer, a ball mill, and the like (mixing step). Prior to the mixing step, it is preferable to perform a step of adding a radical reaction initiator while melt-kneading the binder resin, and crosslinking the binder resin.

Next, the obtained mixture is melt-kneaded using a thermal kneader such as a twin-screw kneading extruder, a heating roll, a kneader, an extruder, or the like (melt kneading step). The melt-kneaded product is cooled and solidified, and then pulverized (pulverization step), and if necessary, classified. As a result, toner particles can be obtained.

The toner particles may be used as they are as a toner. If necessary, a known fluidizing agent may be sufficiently mixed using a mixer such as a Henschel mixer to obtain a toner.

Method for Measuring Content Ratio of Each Monomer Unit in Crystalline Vinyl Resin The content ratio of monomer units derived from various polymerizable monomers in polymer A is measured by $^1$H-NMR under the following conditions.

Measurement device: FT NMR device JNM-EX400 (manufactured by JEOL Ltd.)

Measurement frequency: 400 MHz

Pulse condition: 5.0 μs

Frequency range: 10,500 Hz

Number of integrations: 64 times

Measurement temperature: 30° C.

Sample: 50 mg of a measurement sample is placed in a sample tube with an inner diameter of 5 mm and dissolved in a thermostat at 40° C. by adding deuterated chloroform ($CDCl_3$) as a solvent to prepare a sample.

On the resulting $^1$H-NMR chart, from among the peaks attributable to the constituent components of the monomer unit derived from the polymerizable monomer A, a peak that is independent of the peaks attributable to constituent components derived from other sources is selected and the integrated value $S_1$ of this peak is calculated.

Similarly, from among the peaks attributable to the constituent components of the monomer unit derived from the polymerizable monomer B, a peak that is independent of the peaks attributable to constituent components derived from other sources is selected and the integrated value $S_2$ of this peak is calculated.

Furthermore, from among the peaks attributable to the constituent components of the monomer unit derived from the polymerizable monomer C, a peak that is independent of the peaks attributable to constituent components derived from other sources is selected and the integrated value $S_3$ of this peak is calculated.

The content ratio of the monomer units derived from the polymerizable monomers is obtained in the following manner by using the above integrated values $S_1$, $S_2$, and $S_3$. Here, $n_1$, $n_2$, and $n_3$ are the numbers of hydrogen atoms in the constituent elements to which the peaks that were noticed for the respective segments belong. $M_1$, $M_2$ and $M_3$ are the molecular weights of the respective monomer units.

$$\text{Ratio (mol \%) of monomer unit derived from polymerizable monomer } A=\{(S_1/n_1\times M_1)/((S_1/n_1\times M_1)+(S_2/n_2\times M_2)+(S_3/n_3\times M_3))\}\times 100.$$

Similarly, the ratio of the monomer units derived from the polymerizable monomer B and the polymerizable monomer C are determined in the following manner.

$$\text{Ratio (mol \%) of monomer unit derived from polymerizable monomer } B=\{(S_2/n_2\times M_2)/((S_1/n_1\times M_1)+(S_2/n_2\times M_2)+(S_3/n_3\times M_3))\}\times 100.$$

$$\text{Ratio (mol \%) of monomer units derived from polymerizable monomer } C=\{(S_3/n_3\times M_3)/((S/n_1\times M_1)+(S_2/n_2\times M_2)+(S_3/n_3\times M_3))\}\times 100.$$

When a polymerizable monomer in which a hydrogen atom is not contained in the constituent elements other than the vinyl group is used in the polymer A, the $^{13}$C-NMR is used to set the measurement nucleus to $^{13}$C, measurement is performed in a single pulse mode, and calculation is performed in the same manner as with the $^{1}$H-NMR.

Method for Measuring Proportion of Tetrahydrofuran (THF)-Insoluble Matter of Resin Component A total of 1.5 g of toner for measuring the amount of THF-insoluble matter (0.7 g when measuring THF-insoluble matter of resin alone) is precisely weighed (W1 [g]) placed on cylindrical filter paper (trade name: No. 86R, size 28×100 mm, manufactured by Advantech Toyo Co., Ltd.) that was precisely weighed in advance, and set in a Soxhlet extractor.

Extraction is performed using 200 mL of tetrahydrofuran (THF) as a solvent for 18 hours, and extraction is carried out at a reflux rate such that the extraction cycle of the solvent at that time is once every about 5 minutes.

After completion of the extraction, the cylindrical filter paper is taken out, air-dried, and then vacuum dried at 40° C. for 8 hours, the mass of the cylindrical filter paper including the extraction residue is weighed, and the mass (W2 [g]) of the extraction residue is calculated by subtracting the mass of the cylindrical filter paper.

Also, when recovering the THF-soluble matter, it can be recovered by sufficiently distilling THE from the soluble matter in THF with an evaporator.

Next, the amount (W3 [g]) of the components other than the resin component is determined by the following procedure (when measuring the THF-insoluble matter of the resin alone, W3 is taken as 0 g).

Approximately 2 g of the toner is precisely weighed (Wa [g]) in a 30 mL magnetic crucible weighed in advance.

The magnetic crucible is placed in an electric furnace and heated at about 900° C. for about 3 hours, allowed to cool in the electric furnace, and allowed to cool in a desiccator at room temperature for 1 hour or more, and the mass of the crucible including incineration residual ash is weighed. The incineration residual ash content (Wb [g]) is calculated by subtracting the mass of the crucible.

Then, the mass (W3 [g]) of the incineration residual ash in the sample W1 [g] is calculated by the following formula (A).

$$W3=W1\times(Wb/Wa) \quad \text{(A)}$$

In this case, the amount of THF-insoluble matter and the amount of the incineration residual ash of the resin component in the toner are determined by the following formulas (B) and (C).

$$\text{Proportion of THF-insoluble matter (mass \%)}=\{(W2-W3)/(W1-W3)\}\times 100 \quad \text{(B)}$$

$$\text{Amount of incineration residual ash (mass \%)}=\{W3/(W2-W3)\}\times 100 \quad \text{(C)}$$

Method for Quantifying Amount of Carbon-Carbon Double Bonds

A method for quantifying the amount of the carbon-carbon double bonds in the toner and the polyester resin having the carbon-carbon double bonds can be exemplified by a method including measuring the proton or carbon of the carbon-carbon double bonds with a nuclear magnetic resonance device (NMR) and performing quantitative determination.

For the toner, the measurement is performed by collecting the THF-soluble matter in the <Method for Measuring proportion of Tetrahydrofuran (THF)-Insoluble Matter of Resin Component>.

Sample Adjustment

A total of 100 mg of a sample, 10 mg of sodium trimethylsilylpropane sulfonate as an internal standard substance, and 10 mg of Cr $(AcAc)_3$ as a relaxation reagent are weighed into an NMR sample tube, 0.45 ml of a deuterated solvent (for example, heavy pyridine) is added, and the sample is thoroughly dissolved.

Measurement Conditions

Device: "AVANCE III HD400", manufactured by Bruker BioSpin GmbH

Number of integrations: 24,000 times

Analysis and Calculation

The amount (mmol/g) of double bonds is calculated from the area ratio of the peak of carbon of a double bond derived from the unsaturated carboxylic acid component and the unsaturated alcohol component and the peak of carbon derived from the methyl group of internal standard substance.

For example, where the carbon-carbon double bond is of an unsaturated carboxylic acid component such as maleic acid or fumaric acid, the amount (mmol/g) of the double bonds is calculated from the area ratio of the peak (164.6 ppm) of the double bond derived from the unsaturated carboxylic acid component and the area ratio of the peak (0 ppm) of carbon of the methyl group part of the internal standard substance Measurement Method of Weight Average Particle Diameter (D4) and Number Average Particle Diameter (D1)

The weight average particle diameter (D4) and the number average particle diameter (D1) of the toner are calculated in the following order. A precision particle size distribution measuring device (trade name: Coulter Counter Multisizer 3) based on a pore electric resistance method and equipped with a 100 m aperture tube is used as a measurement device. Dedicated software (trade name: Beckman Coulter Multisizer 3, Version 3.51, manufactured by Beckman Coulter, Inc.) provided with the device is used for setting the measurement conditions and analyzing the measurement data. The measurement is performed with 25,000 effective measurement channels.

A solution prepared by dissolving special grade sodium chloride in ion exchanged water to a concentration of about 1% by mass, for example, "ISOTON II" (manufactured by Beckman Coulter, Inc.), can be used as the electrolytic aqueous solution to be used for measurements.

The dedicated software is set up in the following manner before the measurement and analysis.

The total count number in a control mode is set to 50,000 particles on a "CHANGE STANDARD MEASUREMENT METHOD (SOM)" screen of the dedicated software, the number of measurements is set to 1, and a value obtained using "STANDARD PARTICLES 10.0 m" (manufactured by Beckman Coulter, Inc.) is set as a Kd value. The threshold and the noise level are automatically set by pressing a "MEASUREMENT BUTTON OF THRESHOLD/NOISE LEVEL". Further, the current is set to 1600 μA, the gain is set to 2, the electrolytic solution is set to ISOTON II, and "FLUSH OF APERTURE TUBE AFTER MEASUREMENT" is checked.

In the "PULSE TO PARTICLE DIAMETER CONVERSION SETTING" screen of the dedicated software, the bin interval is set to a logarithmic particle diameter, the particle diameter bin is set to a 256-particle diameter bin, and a particle diameter range is set from 2 m to 60 m.

The specific measurement method is described hereinbelow.

(1) Approximately 200 mL of the electrolytic aqueous solution is placed in a glass 250 mL round-bottom beaker dedicated to Multisizer 3, the beaker is set in a sample stand, and stirring with a stirrer rod is carried out counterclockwise at 24 revolutions per second. Dirt and air bubbles in the aperture tube are removed by the "FLUSH OF APERTURE TUBE" function of the dedicated software.

(2) About 30 mL of the electrolytic aqueous solution is placed in a glass 100 mL flat-bottom beaker. Then, about 0.3 mL of a diluted solution obtained by three-fold mass dilution of "CONTAMINON N" (10% by mass aqueous solution of a neutral detergent for washing precision measuring instruments including a nonionic surfactant, an anionic surfactant, and an organic builder and having pH 7, manufactured by Wako Pure Chemical Industries, Ltd.) with ion exchanged water is added as a dispersant thereto.

(3) An ultrasonic disperser "Ultrasonic Dispersion System Tetora 150" (manufactured by Nikkaki Bios Co., Ltd.) with an electrical output of 120 W in which two oscillators with an oscillation frequency of 50 kHz are built in with a phase shift of 180 degrees is prepared. About 3.3 L of ion exchanged water is placed in the water tank of the ultrasonic disperser, and about 2 mL of the CONTAMINON N is added to the water tank.

(4) The beaker of (2) hereinabove is set in the beaker fixing hole of the ultrasonic disperser, and the ultrasonic disperser is actuated. Then, the height position of the beaker is adjusted so that the resonance state of the liquid surface of the electrolytic aqueous solution in the beaker is maximized.

(5) About 10 mg of the toner is added little by little to the electrolytic aqueous solution and dispersed therein in a state in which the electrolytic aqueous solution in the beaker of (4) hereinabove is irradiated with ultrasonic waves. Then, the ultrasonic dispersion process is further continued for 60 seconds. In the ultrasonic dispersion, the water temperature in the water tank is adjusted, as appropriate, to a temperature from 10° C. to 40° C.

(6) The electrolytic aqueous solution of (5) hereinabove in which the toner is dispersed is dropped using a pipette into the round bottom beaker of (1) hereinabove which has been set in the sample stand, and the measurement concentration is adjusted to be about 5%. Then, measurement is conducted until the number of particles to be measured reaches 50,000.

(7) The measurement data are analyzed with the dedicated software provided with the device, and the weight average particle diameter (D4) and the number average particle diameter (D1) are calculated. The "AVERAGE DIAMETER" on the "ANALYSIS/VOLUME STATISTICAL VALUE (ARITHMETIC MEAN)" screen when the dedicated software is set to graph/volume % is the weight average particle diameter (D4). The "AVERAGE DIAMETER" on the "ANALYSIS/NUMBER STATISTICAL VALUE (ARITHMETIC MEAN)" screen when the dedicated software is set to graph/number % is the number average particle diameter (D1).

Method for Measuring Storage Elastic Modulus G'

In the toner of the present invention, the storage elastic modulus G' is measured using a viscoelasticity measurement device (rheometer) ARES (manufactured by Rheometrics Scientific, Inc.). The outline of the measurement is described in the ARES operation manuals 902-30004 (version of August 1997) and 902-00153 (version of July 1993) issued by Rheometrics Scientific Inc, and is as follows.

Measurement jig: torsion rectangular

Measurement sample: for the toner, a rectangular parallelepiped sample having a width of about 12 mm, a height of about 20 mm and a thickness of about 2.5 mm is produced using a pressure molding machine (maintaining 15 kN for 1 minute at room temperature). As the pressure molding machine, a 100 kN press NT-100H manufactured by NPa System Co., Ltd. is used.

The jig and sample are allowed to stand at room temperature (23° C.) for 1 hour, and the sample is attached to the jig (see FIG. 1). As shown in the figure, the sample is fixed to obtain a width of about 12 mm, a thickness of about 2.5 mm, and a height of 10.0 mm of a measurement portion. After adjusting the temperature to the measurement start temperature of 30° C. for 10 minutes, the measurement is performed with the following settings.

Measurement frequency: 6.28 rad/s.

Measurement distortion setting: initial value is set to 0.1% and measurement is performed in an automatic measurement mode.

Sample extension correction: adjusted in the automatic measurement mode.

Measurement temperature: temperature is raised from 30° C. to 180° C. at a rate of 2° C. per minute.

Measurement interval: viscoelasticity data are measured every 30 seconds, that is, every 1° C.

Data are transferred through an interface to an RSI Orchestrator (control, data collection and analysis software) (manufactured by Rheometrics Scientific, Inc.) operating on Microsoft Windows 7.

The values of storage modulus G'(50), G'(100), G'(T150) at each temperature of 50° C., 100° C. and 150° C. are read.

Method for Measuring of Glass Transition Temperature Tg

The glass transition temperature Tg of the THF-insoluble matter of the resin component in the toner is measured according to ASTM D3418-82 by using a differential scanning calorimeter "Q2000" (manufactured by TA Instruments). The melting points of indium and zinc are used to correct the temperature of the device detection unit, and the heat of fusion of indium is used to correct the amount of heat.

For the THF-insoluble matter of the resin component, the extraction residue of the toner in the <Method for Measuring Proportion of Tetrahydrofuran (THF) Insoluble Matter of Resin Component> is recovered from the cylindrical filter paper.

Specifically, about 2 mg of the extraction residue is precisely weighed and placed in an aluminum pan, an empty aluminum pan is used as a reference, and the measurement is performed in a measurement temperature range of from −10° C. to 200° C. at a temperature rising rate of 10° C./min.

In the measurement, the temperature is once raised to 200° C., then lowered to −10° C., and then raised again. A change in the specific heat is obtained in the temperature range of from 30° C. to 100° C. in the second temperature rising process. The intersection point between the differential heat curve and the line at the midpoint of the baseline before and after the change in the specific heat at this time is defined as the glass transition temperature Tg.

Measurement of Weight Average Molecular Weight Mw, Number Average Molecular Weight Mn and Peak Top Molecular Weight Mp (Measurement of Molecular Weight Distribution of Release Agent and THF-Soluble Matter of Resin and Toner)

The molecular weight distribution of the release agent and the THF-soluble matter of the toner and the resin such as the polymer A is measured by gel permeation chromatography (GPC) in the following manner.

First, a sample is dissolved in tetrahydrofuran (THF) at room temperature for 24 hours. Then, the obtained solution is filtered through a solvent-resistant membrane filter "MAISHORI DISK" (manufactured by Tosoh Corporation) having a pore diameter of 0.2 m to obtain a sample solution. The sample solution is adjusted so that the concentration of the THF-soluble matter is 0.8% by mass. This sample solution is used for measurement under the following conditions.

Device: HLC8120 GPC (detector: RI) (manufactured by Tosoh Corporation)

Columns: Septal column, Shodex KF-801, 802, 803, 804, 805, 806, 807 (Showa Denko KK)

Eluent: tetrahydrofuran (THF)

Flow rate: 1.0 ml/min

Oven temperature: 40.0° C.

Sample injection volume: 0.10 ml

In calculating the molecular weight of the sample, a molecular weight calibration curve created using a standard polystyrene resin (for example, trade names "TSK Standard Polystyrene F-850, F-450, F-288, F-128, F-80, F-40, F-20, F-10, F-4, F-2, F-1, A-5000, A-2500, A-1000, A-500", manufactured by Tosoh Corp.) is used.

Method for Measuring Melting Point

Melting points of polymer A, polyester resin, release agent, and the like are measured using DSC Q1000 (manufactured by TA Instruments) under the following conditions.

Temperature rising rate: 10° C./min

Measurement start temperature: 20° C.

Measurement end temperature: 180° C.

The melting points of indium and zinc are used for the temperature correction of the device detection unit, and the heat of fusion of indium is used for the correction of the heat quantity.

Specifically, about 5 mg of a sample is precisely weighed and placed in an aluminum pan, and differential scanning calorimetry is performed. An empty silver pan is used as a reference.

The peak temperature of the maximum endothermic peak in the first heating process is taken as the melting point.

The maximum endothermic peak is the peak with the maximum endothermic quantity when there are multiple peaks.

Measurement of Endothermic Quantity of Tetrahydrofuran-Insoluble Content of Resin Component in Toner The endothermic quantity of the tetrahydrofuran-insoluble matter in the toner is measured under the following conditions using DSC Q1000 (manufactured by TA Instruments).

Temperature rising rate: 10° C./min

Measurement start temperature: 20° C.

Measurement end temperature: 180° C.

The melting points of indium and zinc are used for the temperature correction of the device detection unit, and the heat of fusion of indium is used for the correction of the heat quantity.

Specifically, about 5 mg of the extraction residue described in the method for measuring the amount of THF-insoluble matter is precisely weighed and placed in an aluminum pan, and differential scanning calorimetry is performed. An empty silver pan is used as a reference.

In the measurement, the temperature is once raised to 200° C., then lowered to 10° C., and then raised again. In the DSC curve obtained during this temperature raising process, the temperature Tm at the peak top of the maximum endothermic peak in the temperature range of from 10° C. to 200° C. is determined. The endothermic quantity H of the endothermic peak of the extraction residue is the integral value of the endothermic peak. The endothermic quantity (H(I)) of the present invention is calculated by the following formula (E).

$$\text{Endothermic quantity } (H(I))(\text{J/g})=\{H\times W2/(W2-W3)\}\times 100 \quad \text{(E)}$$

Measurement of Degree of Agglomeration of Toner

In the toner, a powder tester (manufactured by Hosokawa Micron Co., Ltd.) is used as a device for measuring a degree of agglomeration. As a measuring method, 400 mesh (opening 38 m), 200 mesh (opening 75 m) and 100 mesh (opening 150 m) sieves are placed on the vibrating table in the order of narrow opening, that is, 400 mesh, 200 mesh, and 100 mesh are piled up in this order and set so that the 100 mesh sieve is at the top.

A total of 5 g of the sample weighed accurately is added onto the 100 mesh sieve set, the input voltage to the vibrating table is controlled to adjust the amplitude of the vibrating table to be in the range of from 60 m to 90 m, and vibrations are applied (the rheostat scale about 2.5) for about 15 seconds. Then, the mass of the sample remaining on each sieve is measured to obtain the degree of agglomeration according to the following formula.

(Degree of agglomeration)=(Mass of toner laid on 100 mesh)/(mass of toner initially laid on sieve)+(mass of toner laid on 200 mesh)/(mass of toner initially laid on sieve)×⅗+(mass of toner laid on 400 mesh)/(mass of toner initially laid on the sieve)×⅕

Measurement of Softening Point (½ Outflow Temperature) of Resin

The softening point (½ outflow temperature) of the resin can be measured using a constant-load extrusion-type capillary rheometer "Flow characteristic evaluation device FLOW TESTER CFT-500D" (manufactured by Shimadzu Corporation).

The CFT-500D is a device in which the measurement sample filled in a cylinder is melted by raising the temperature and pushed out from a thin tube hole at the bottom of the cylinder while applying a constant load from the top with a piston, and a flow curve can be plotted from the descent amount (mm) of the piston and temperature (° C.) at this time.

In the present invention, the "melting temperature in the ½ method" described in the manual provided with the "flow characteristic evaluation device FLOW TESTER CFT-500D" is taken as the softening point (½ outflow temperature).

The melting temperature in the ½ method is calculated in the following manner.

First, one half of the difference between the piston descent amount at the time of outflow end (outflow end point, Smax) and the piston descent amount at the time of outflow start (minimum point, Smin) is obtained (this is denoted by X. X=(Smax−Smin)/2). Then, the temperature of the flow curve when the descent amount of the piston becomes the sum of X and Smin is taken as the melting temperature in the ½ method.

Method for Measuring Acid Value

The acid value is the mass [mg] of potassium hydroxide required to neutralize the acid contained in 1 g of the sample. That is, the mass [mg] of potassium hydroxide required to neutralize a free fatty acid, a resin acid, and the like contained in 1 g of the sample is called the acid value.

The acid value is measured according to JIS K 0070-1992. Specifically, it is measured according to the following procedure.

(1) Preparation of Reagents

A total of 1.0 g of phenolphthalein is dissolved in 90 mL of ethyl alcohol (95% by volume), and ion exchanged water is added to make 100 mL and obtain a phenolphthalein solution.

A total of 7 g of special grade potassium hydroxide is dissolved in 5 mL of water and ethyl alcohol (95% by volume) is added to make 1 L. The solution is placed in an alkali resistant container and allowed to stand for 3 days so that contact with carbon dioxide or the like is prevented. After standing, the solution is filtered to obtain a potassium hydroxide solution. The obtained potassium hydroxide solution is stored in an alkali resistant container.

A total of 25 mL of 0.1 mol/L hydrochloric acid is placed in an Erlenmeyer flask, a few drops of the phenolphthalein solution is added, titration is performed with the above potassium hydroxide solution, and a factor of the potassium hydroxide solution is determined from the amount of the potassium hydroxide solution required for neutralization. The 0.1 mol/L hydrochloric acid prepared according to JIS K 8001-1998 is used.

(2) Operation (A) Main Test

A total of 2.0 g of sample is placed into a 200 mL Erlenmeyer flask and accurately weighed, 100 mL of a mixed solution of toluene/ethanol (2:1) is added, and the sample is dissolved over 5 hours. Then, a few drops of the phenolphthalein solution are added as an indicator, and titration is performed using the potassium hydroxide solution. The end point of the titration is when the light red color of the indicator continues for 30 seconds.

(B) Blank Test

The same titration as above is performed except that the sample is not added (that is, only the mixed solution of toluene/ethanol (2:1) is used).

(3) Calculation of Acid Value

The obtained result is substituted into the following formula to calculate the acid value.

$$AV=[(B-A)\times f\times 5.61]/S$$

In the above formula, AV represents the acid value [mg KOH/g], A represents the addition amount [mL] of the potassium hydroxide solution in the blank test, B represents the addition amount [mL] of the potassium hydroxide solution in the main test, f represents the factor of the potassium hydroxide solution, and S represents the mass [g] of the sample.

EXAMPLES

Hereinafter, the present invention will be described in more detail with reference to Examples and Comparative Examples, but the present invention is not limited thereto. Parts used in the examples are based on mass unless otherwise specified.

Production Example of Polymer A1

The following materials were put into a reaction vessel equipped with a reflux condenser, a stirrer, a thermometer, and a nitrogen inlet tube under a nitrogen atmosphere.

| | |
|---|---|
| Toluene | 100.0 parts |
| Behenyl acrylate (polymerizable monomer A) | 70.0 parts |
| Styrene (polymerizable monomer B) | 15.0 parts |
| Methacrylonitrile (polymerizable monomer C) | 15.0 parts |

t-Butyl peroxypivalate (manufactured by Nippon Oil & Fat Corp.: PERBUTYL PV) 3.0 parts The materials were heated to 70° C., and a polymerization reaction was performed for 12 hours while stirring the inside of the reaction vessel at 200 rpm to obtain a solution in which the polymer of the monomer composition was dissolved in toluene. Subsequently, the temperature of the solution was lowered to 25° C., and then the solution was poured into 1000.0 parts of methanol while stirring to precipitate a methanol insoluble matter. The obtained methanol-insoluble matter was separated by filtration, further washed with methanol, and vacuum dried at 40° C. for 24 hours to obtain a polymer A1.

The polymer A1 had a weight average molecular weight of 14,000, an acid value of 0.0 mg KOH/g, and a melting point Tm of 61.0° C.

Production Example of Polymers A2 to A7

Polymers A2 to A7 were synthesized under the same conditions except that the addition amounts of the polymerizable monomers A, B and C were changed as shown in Table 1. Table 1 shows various physical properties of the polymers A2 to A7.

TABLE 1

| | Polymerizable monomer A | | Polymerizable monomer B | | Polymerizable monomer C | | | Molecular Weight | | |
|---|---|---|---|---|---|---|---|---|---|---|
| | Type | Addition amount (parts) | Type | Addition amount (parts) | Type | Addition amount (parts) | Tm ° C. | Number average molecular weight Mn | Weight average molecular weight Mw | Mw/Mn |
| Polymer A1 | Behenyl acrylate | 70.0 | Styrene | 15.0 | Methacrylonitrile | 15.0 | 61.0 | 14000 | 64000 | 4.6 |
| Polymer A2 | Behenyl acrylate | 52.0 | Styrene | 24.0 | Methacrylonitrile | 24.0 | 61.0 | 15000 | 56000 | 3.7 |
| Polymer A3 | Behenyl acrylate | 35.0 | Styrene | 32.5 | Methacrylonitrile | 32.5 | 61.0 | 14000 | 63000 | 4.5 |
| Polymer A4 | Behenyl acrylate | 90.0 | Styrene | 5.0 | Methacrylonitrile | 5.0 | 61.0 | 15000 | 57000 | 3.8 |
| Polymer A5 | Behenyl acrylate | 28.0 | Styrene | 36.0 | Methacrylonitrile | 36.0 | 61.0 | 14000 | 60000 | 4.3 |
| Polymer A6 | Myristyl acrylate | 70.0 | Styrene | 15.0 | Methacrylonitrile | 15.0 | 76.0 | 15000 | 60000 | 4.0 |
| Polymer A7 | Stearyl acrylate | 70.0 | Styrene | 15.0 | Methacrylonitrile | 15.0 | 56.0 | 15000 | 64000 | 4.3 |

Production Example of Polyester Resin B1

The following materials were put into a reaction vessel equipped with a reflux condenser, a stirrer, a thermometer, and a nitrogen inlet tube under a nitrogen atmosphere.

| | |
|---|---|
| Bisphenol A - ethylene oxide 2 mole adduct | 650.0 parts |
| Terephthalic acid | 120.0 parts |
| Adipic acid | 120.0 parts |
| Trimethylol propane | 15.0 parts |
| Titanium diisopropoxy-bis-triethanol aminate | 2.5 parts |

The above materials were reacted for 2 hours at 230° C. under a nitrogen stream while distilling off the produced water. Next, the reaction was performed under a reduced pressure of 2.5 kPa for 5 hours, and then the temperature was lowered to 180° C. A total of 1 part of tert-butylcatechol was added as a polymerization inhibitor, 60.0 parts of fumaric acid was further added, the components were reacted for 8 hours under a reduced pressure of 0.5 kPa to 2.5 kPa, and the reaction product was taken out as a polyester resin B1.

The amount of double bonds in the polyester B1 was 0.39 mmol/g.

Production Examples of Polyester Resins B2 to B12

Polyester resins B2 to B12 were synthesized under the same conditions except that the addition amount of each monomer in the Production Example of Polyester Resin B1 was changed as shown in Table 2. Table 2 shows various physical properties.

TABLE 2

| Polyester resin B No. | Alcohol component (parts) | | | | Acid component (parts) | | | | | Molecular weight | | | Equivalent amount of double bonds mmol/g |
|---|---|---|---|---|---|---|---|---|---|---|---|---|---|
| | BPA-2EO | BPA-2PO | Butane diol | Trimethylol propane | Terephthalic acid | Sebacic acid | Adipic acid | Trimellitic anhydride | Fumaric acid | Mn | Mw | Mw/Mn | |
| B1 | 650.0 | 0.0 | 0.0 | 15.0 | 120.0 | 0.0 | 120.0 | 0.0 | 60.0 | 3476 | 12000 | 3.5 | 0.39 |
| B2 | 620.0 | 0.0 | 0.0 | 15.0 | 120.0 | 0.0 | 120.0 | 0.0 | 50.0 | 3705 | 12500 | 3.4 | 0.34 |
| B3 | 575.0 | 0.0 | 0.0 | 15.0 | 120.0 | 0.0 | 120.0 | 0.0 | 25.0 | 3296 | 13500 | 4.1 | 0.18 |
| B4 | 850.0 | 0.0 | 0.0 | 15.0 | 120.0 | 0.0 | 120.0 | 0.0 | 150.0 | 3657 | 12500 | 3.4 | 0.75 |
| B5 | 650.0 | 0.0 | 0.0 | 15.0 | 120.0 | 0.0 | 120.0 | 10.0 | 60.0 | 4607 | 13300 | 2.9 | 0.38 |
| B6 | 650.0 | 0.0 | 0.0 | 15.0 | 120.0 | 0.0 | 120.0 | 20.0 | 60.0 | 6927 | 20000 | 2.9 | 0.38 |
| B7 | 650.0 | 0.0 | 0.0 | 15.0 | 180.0 | 0.0 | 60.0 | 0.0 | 60.0 | 3042 | 12000 | 3.9 | 0.39 |
| B8 | 0.0 | 752.0 | 0.0 | 0.0 | 313.0 | 0.0 | 0.0 | 1.0 | 1.0 | 4057 | 10200 | 2.5 | 0.01 |
| B9 | 727.0 | 0.0 | 0.0 | 26.0 | 132.0 | 0.0 | 142.0 | 1.0 | 48.0 | 2396 | 23600 | 9.8 | 0.28 |
| B10 | 741.0 | 0.0 | 0.0 | 13.0 | 119.0 | 0.0 | 120.0 | 0.0 | 86.0 | 2918 | 9000 | 3.1 | 0.50 |
| B11 | 0.0 | 0.0 | 75.0 | 0.0 | 0.0 | 145.0 | 0.0 | 0.0 | 10.0 | 4736 | 16000 | 3.4 | 0.27 |
| B12 | 0.0 | 0.0 | 76.0 | 0.0 | 0.0 | 134.0 | 0.0 | 0.0 | 20.0 | 4492 | 15000 | 3.3 | 0.54 |

BPA-2EO: Bisphenol A—ethylene oxide 2 mol adduct

BPA-2PO: Bisphenol A—propylene oxide 2 mol adduct

Production Example of Polyester Resin B13

The following materials were put into a reaction vessel equipped with a reflux condenser, a stirrer, a thermometer, and a nitrogen inlet tube under a nitrogen atmosphere.

| | |
|---|---|
| 1,6-Hexanediol | 100.0 parts |
| Fumaric acid | 100.0 parts |
| tert-Butyl catechol | 1.0 part |
| Titanium diisopropoxy-bis-triethanol aminate | 0.5 part |

The above materials were reacted for 2 hours at 230° C. under a nitrogen stream while distilling off the produced water. Next, the reaction was performed under a reduced pressure of 2.5 kPa for 5 hours, and then the temperature was lowered to 180° C. The reaction was further conducted under reduced pressure of 0.5 kPa to 2.5 kPa for 8 hours, and the reaction product was taken out as a polyester resin B13.

The amount of double bonds in the polyester resin B13 was 3.0 mmol/g, the melting point Tm was 112° C., and the weight average molecular weight Mw was 25,000.

Production Example of Polyester Resin B14

The following materials were put into a reaction vessel equipped with a reflux condenser, a stirrer, a thermometer, and a nitrogen inlet tube under a nitrogen atmosphere.

| | |
|---|---|
| Bisphenol A - propylene oxide 1 mol adduct | 60.0 parts |
| Bisphenol A - ethylene oxide 1 mol adduct | 40.0 parts |
| Terephthalic acid | 50.0 parts |
| Dodecenyl succinic anhydride | 25.0 parts |
| Trimellitic anhydride | 20.0 parts |
| Titanium diisopropoxy-bis-triethanol aminate | 0.5 part |

The above materials were reacted for 2 hours at 230° C. under a nitrogen stream while distilling off the produced water. Next, the reaction was performed under a reduced pressure of 2.5 kPa for 5 hours, and then the temperature was lowered to 180° C. After further reacting under reduced pressure of 0.5 to 2.5 kPa for 8 hours, the reaction product was taken out to obtain a polyester resin B14.

The polyester resin B14 had a Tg of 61° C. and an acid value of 24.3 mg KOH/g.

Production Example of Binder Resin C1

A total of 60 parts of the polymer $A_1$ and 40 parts of the polyester resin B1 were mixed and supplied to a twin-screw kneader (manufactured by Kurimoto Iron Works, Ltd., S5KRC kneader) at 40 kg/h, and at the same time, 4.0 parts of t-butylperoxyisopropyl monocarbonate as a radical reaction initiator was supplied at 0.4 kg/h, and the reaction was performed by kneading and extruding at 100 rpm for 5 minutes at 160° C. Mixing was then performed while causing nitrogen to flow from a vent port to remove the organic solvent. A binder resin C1 was obtained by cooling the mixture obtained.

The obtained binder resin C1 had a polymer $A_1$ segment as a crystalline segment, and an amorphous modified resin segment, in which the polymer $A_1$ and the polyester resin B1 were crosslinked by carbon-carbon bonds, as an amorphous segment.

Production Example of Binder Resins C2 to C32

Binder resins C2 to C32 were synthesized under the same conditions except that the types and the addition amounts of the polymer $A_1$ and the polyester resin B1 and the addition amount of the radical reaction initiator in the Production Example of Binder Resin C1 were changed as shown in Table 3. Table 3 shows various physical properties.

The obtained binder resins C2 to C28 had a segment corresponding to the type of the polymer A used as a crystalline segment, and an amorphous modified resin segment, in which resins corresponding to the respective polymer A and polyester resin B used were crosslinked by carbon-carbon bonds, as an amorphous segment.

In the obtained binder resins C29 to C31, crosslinking between molecules of the polyester resin was confirmed, but crosslinking between the polymer A and the polyester resin was not confirmed.

Further, it was not confirmed that the obtained binder resin C32 had a crosslinked structure.

TABLE 3

| Binder resin No. | Polymer A | Addition amount (parts) | Polyester resin B | Addition amount (parts) | Addition amount of radical reaction initiator (parts) | Molecular weight Mn | Mw | Mw/Mn |
|---|---|---|---|---|---|---|---|---|
| C1 | Polymer A1 | 60.0 | Polyester resin B1 | 40.0 | 4.0 | 12000 | 49148 | 4.1 |
| C2 | Polymer A2 | 60.0 | Polyester resin B1 | 40.0 | 4.0 | 12500 | 50703 | 4.1 |
| C3 | Polymer A3 | 60.0 | Polyester resin B1 | 40.0 | 4.0 | 12500 | 52500 | 4.2 |
| C4 | Polymer A4 | 60.0 | Polyester resin B1 | 40.0 | 4.0 | 13500 | 55292 | 4.1 |
| C5 | Polymer A5 | 60.0 | Polyester resin B1 | 40.0 | 4.0 | 13300 | 53948 | 4.1 |
| C6 | Polymer A1 | 80.0 | Polyester resin B1 | 20.0 | 4.0 | 14843 | 56403 | 3.8 |
| C7 | Polymer A1 | 75.0 | Polyester resin B1 | 25.0 | 4.0 | 14575 | 49823 | 3.4 |
| C8 | Polymer A1 | 70.0 | Polyester resin B1 | 30.0 | 4.0 | 14307 | 48267 | 3.4 |
| C9 | Polymer A1 | 55.0 | Polyester resin B1 | 45.0 | 4.0 | 14039 | 57500 | 4.1 |
| C10 | Polymer A6 | 60.0 | Polyester resin B1 | 40.0 | 4.0 | 13500 | 56700 | 4.2 |
| C11 | Polymer A7 | 60.0 | Polyester resin B1 | 40.0 | 4.0 | 13300 | 57190 | 4.3 |
| C12 | Polymer A1 | 60.0 | Polyester resin B1 | 40.0 | 6.0 | 11500 | 48815 | 4.2 |
| C13 | Polymer A1 | 60.0 | Polyester resin B1 | 40.0 | 2.0 | 12000 | 53199 | 4.4 |
| C14 | Polymer A1 | 60.0 | Polyester resin B2 | 40.0 | 4.0 | 13771 | 47077 | 3.4 |
| C15 | Polymer A1 | 60.0 | Polyester resin B3 | 40.0 | 4.0 | 13504 | 45556 | 3.4 |
| C16 | Polymer A1 | 60.0 | Polyester resin B4 | 40.0 | 4.0 | 10200 | 47142 | 4.6 |
| C17 | Polymer A1 | 60.0 | Polyester resin B1 | 40.0 | 0.5 | 11207 | 53909 | 4.8 |
| C18 | Polymer A1 | 60.0 | Polyester resin B1 | 40.0 | 5.0 | 10989 | 52749 | 4.8 |

TABLE 3-continued

| Binder resin No. | Polymer A | Addition amount (parts) | Polyester resin B | Addition amount (parts) | Addition amount of radical reaction initiator (parts) | Molecular weight Mn | Mw | Mw/Mn |
|---|---|---|---|---|---|---|---|---|
| C19 | Polymer A1 | 60.0 | Polyester resin B1 | 40.0 | 1.0 | 10771 | 48471 | 4.5 |
| C20 | Polymer A1 | 60.0 | Polyester resin B1 | 40.0 | 4.5 | 10533 | 36007 | 3.4 |
| C21 | Polymer A1 | 60.0 | Polyester resin B5 | 40.0 | 4.0 | 10366 | 34973 | 3.4 |
| C22 | Polymer A1 | 60.0 | Polyester resin B6 | 40.0 | 4.0 | 10200 | 41774 | 4.1 |
| C23 | Polymer A1 | 60.0 | Polyester resin B7 | 40.0 | 4.0 | 13236 | 46325 | 3.5 |
| C24 | Polymer A1 | 55.0 | Polyester resin B1 | 45.0 | 4.0 | 12968 | 46684 | 3.6 |
| C25 | Polyester resin B11 | 60.0 | Polyester resin B1 | 40.0 | 4.0 | 12700 | 39545 | 3.1 |
| C26 | Polyester resin B12 | 60.0 | Polyester resin B1 | 40.0 | 4.0 | 12432 | 41055 | 3.3 |
| C27 | Polymer A1 | 30.0 | Polyester resin B1 | 70.0 | 4.0 | 12164 | 42463 | 3.5 |
| C28 | Polymer A1 | 90.0 | Polyester resin B1 | 10.0 | 4.0 | 11896 | 43770 | 3.7 |
| C29 | Polymer A1 | 60.0 | Polyester resin B8 | 40.0 | 1.0 | 11500 | 44479 | 3.9 |
| C30 | Polymer A1 | 60.0 | Polyester resin B9 | 40.0 | 1.0 | 12000 | 48675 | 4.1 |
| C31 | Polymer A1 | 60.0 | Polyester resin B10 | 40.0 | 1.0 | 10200 | 43297 | 4.2 |
| C32 | Polymer A1 | 60.0 | Polyester resin B1 | 40.0 | 0.0 | 11207 | 35000 | 4.4 |

Production Example of Toner Particle 1

| | |
|---|---|
| Binder resin C1 | 100.0 parts |
| Spherical magnetic iron oxide particles (number average particle diameter of primary particles: 0.20 μm, Hc = 6.0 kA/m, σs = 85.2 $Am^2/kg$, σr = 6.5 $Am^2/kg$) | 95.0 parts |
| Release agent 1 (EXCEREX 15341PA, molecular weight (Mp) 1700, melting point 89° C., manufactured by Mitsui Chemicals, Inc.) | 4.0 parts |
| Charge control agent T-77 (manufactured by Hodogaya Chemical Co., Ltd.) | 2.0 parts |

The above materials were premixed with an FM mixer (manufactured by Nippon Coke Industry Co., Ltd.), and then melt-kneaded at a set temperature of 160° C. by a twin-screw kneading extruder (PCM-30 type manufactured by Ikegai Tekko Co., Ltd.).

The obtained kneaded product was cooled, coarsely pulverized with a hammer mill, and then pulverized with a mechanical pulverizer (T-250 manufactured by Turbo Kogyo Co., Ltd.). The obtained finely pulverized powder was classified using a multi-zone classifier using a Coanda effect to obtain toner particles 1 having a weight average particle diameter (D4) of 7.1 m.

Production Example of Toner 1

A total of 100 parts of the toner particles 1 and 2.0 parts of hydrophobic silica fine powder (number average particle diameter of primary particles: 10 nm, BET specific surface area of original silica 200 $m^2/g$) were external-addition mixed using a FM mixer (manufactured by Nippon Coke Industry Co., Ltd.) to obtain a toner 1. Table 5 shows the physical properties of the toner 1.

Production Examples of Toners 2 to 38

Toner particles 2 to 38 were obtained by changing the binder resin C1 and the release agent (described in Table 5) used in the Production Example of Toner Particles 1 as shown in Table 4. Further, toners 2 to 38 were obtained in the same manner as in the Production Example of Toner 1, except that the toner particles used were changed. Table 5 shows the physical properties.

TABLE 4

| Toner No. | Binder resin No. | Binder resin Addition amount (parts) | Colorant, spherical magnetic iron oxide particles Addition amount (parts) | Release agent Type | Release agent Addition amount (parts) | Charge control agent Type | Charge control agent Addition amount (parts) | Hydrophobic silica fine powder Addition amount (parts) |
|---|---|---|---|---|---|---|---|---|
| 1 | C1 | 100.0 | 95.0 | 15341PA | 4.0 | T-77 | 2.0 | 2.0 |
| 2 | C2 | 100.0 | 95.0 | 15341PA | 4.0 | T-77 | 2.0 | 2.0 |
| 3 | C3 | 100.0 | 95.0 | 15341PA | 4.0 | T-77 | 2.0 | 2.0 |
| 4 | C4 | 100.0 | 95.0 | 15341PA | 4.0 | T-77 | 2.0 | 2.0 |
| 5 | C5 | 100.0 | 95.0 | 15341PA | 4.0 | T-77 | 2.0 | 2.0 |
| 6 | C6 | 100.0 | 95.0 | 15341PA | 4.0 | T-77 | 2.0 | 2.0 |
| 7 | C7 | 100.0 | 95.0 | 15341PA | 4.0 | T-77 | 2.0 | 2.0 |
| 8 | C8 | 100.0 | 95.0 | 15341PA | 4.0 | T-77 | 2.0 | 2.0 |
| 9 | C9 | 100.0 | 95.0 | 15341PA | 4.0 | T-77 | 2.0 | 2.0 |
| 10 | C10 | 100.0 | 95.0 | 15341PA | 4.0 | T-77 | 2.0 | 2.0 |
| 11 | C11 | 100.0 | 95.0 | 15341PA | 4.0 | T-77 | 2.0 | 2.0 |
| 12 | C12 | 100.0 | 95.0 | 15341PA | 4.0 | T-77 | 2.0 | 2.0 |
| 13 | C13 | 100.0 | 95.0 | 15341PA | 4.0 | T-77 | 2.0 | 2.0 |
| 14 | C14 | 100.0 | 95.0 | 15341PA | 4.0 | T-77 | 2.0 | 2.0 |
| 15 | C15 | 100.0 | 95.0 | 15341PA | 4.0 | T-77 | 2.0 | 2.0 |
| 16 | C16 | 100.0 | 95.0 | 15341PA | 4.0 | T-77 | 2.0 | 2.0 |

TABLE 4-continued

| Toner No. | Binder resin No. | Binder resin Addition amount (parts) | Colorant, spherical magnetic iron oxide particles Addition amount (parts) | Release agent Type | Release agent Addition amount (parts) | Charge control agent Type | Charge control agent Addition amount (parts) | Hydrophobic silica fine powder Addition amount (parts) |
|---|---|---|---|---|---|---|---|---|
| 17 | C17 | 100.0 | 95.0 | 15341PA | 4.0 | T-77 | 2.0 | 2.0 |
| 18 | C18 | 100.0 | 95.0 | 15341PA | 4.0 | T-77 | 2.0 | 2.0 |
| 19 | C19 | 100.0 | 95.0 | 15341PA | 4.0 | T-77 | 2.0 | 2.0 |
| 20 | C20 | 100.0 | 95.0 | 15341PA | 4.0 | T-77 | 2.0 | 2.0 |
| 21 | C1 | 100.0 | 95.0 | 30050B | 4.0 | T-77 | 2.0 | 2.0 |
| 22 | C1 | 100.0 | 95.0 | HP10A | 4.0 | T-77 | 2.0 | 2.0 |
| 23 | C1 | 100.0 | 95.0 | 2203A | 4.0 | T-77 | 2.0 | 2.0 |
| 24 | C1 | 100.0 | 95.0 | 20700 | 4.0 | T-77 | 2.0 | 2.0 |
| 25 | C1 | 100.0 | 95.0 | C105 | 4.0 | T-77 | 2.0 | 2.0 |
| 26 | C1 | 100.0 | 95.0 | HNP9 | 4.0 | T-77 | 2.0 | 2.0 |
| 27 | C21 | 100.0 | 95.0 | 15341PA | 4.0 | T-77 | 2.0 | 2.0 |
| 28 | C22 | 100.0 | 95.0 | 15341PA | 4.0 | T-77 | 2.0 | 2.0 |
| 29 | C23 | 100.0 | 95.0 | 15341PA | 4.0 | T-77 | 2.0 | 2.0 |
| 30 | C24 | 100.0 | 95.0 | 15341PA | 4.0 | T-77 | 2.0 | 2.0 |
| 31 | C25 | 100.0 | 95.0 | 15341PA | 4.0 | T-77 | 2.0 | 2.0 |
| 32 | C26 | 100.0 | 95.0 | 15341PA | 4.0 | T-77 | 2.0 | 2.0 |
| 33 | C27 | 100.0 | 95.0 | 15341PA | 4.0 | T-77 | 2.0 | 2.0 |
| 34 | C28 | 100.0 | 95.0 | 15341PA | 4.0 | T-77 | 2.0 | 2.0 |
| 35 | C29 | 100.0 | 95.0 | HNP9 | 4.0 | T-77 | 2.0 | 2.0 |
| 36 | C30 | 100.0 | 95.0 | HNP9 | 4.0 | T-77 | 2.0 | 2.0 |
| 37 | C31 | 100.0 | 95.0 | HNP9 | 4.0 | T-77 | 2.0 | 2.0 |
| 38 | C32 | 100.0 | 95.0 | HNP9 | 4.0 | T-77 | 2.0 | 2.0 |

TABLE 6

| | Particle diameter | | | Molecular weight | | | Analysis of extraction residue: Endothermic quantity H | Analysis of extraction residue: Proportion of incineration residual ash |
|---|---|---|---|---|---|---|---|---|
| | D4 | D1 | D4/D1 | Mn | Mw | Mw/Mn | J/g | % by mass |
| Toner 1 | 7.1 | 5.8 | 1.22 | 11500 | 48648 | 4.23 | 10 | 61% |
| Toner 2 | 7.0 | 5.9 | 1.19 | 12000 | 50203 | 4.18 | 7 | 61% |
| Toner 3 | 6.9 | 5.8 | 1.19 | 12000 | 52000 | 4.33 | 4 | 62% |
| Toner 4 | 6.8 | 5.7 | 1.19 | 13000 | 54792 | 4.21 | 26 | 59% |
| Toner 5 | 7.0 | 5.9 | 1.19 | 12800 | 53448 | 4.18 | 10 | 63% |
| Toner 6 | 7.0 | 5.9 | 1.19 | 14343 | 55903 | 3.90 | 25 | 65% |
| Toner 7 | 6.7 | 5.9 | 1.14 | 14075 | 49323 | 3.50 | 20 | 64% |
| Toner 8 | 7.0 | 6.1 | 1.15 | 13807 | 47767 | 3.46 | 18 | 63% |
| Toner 9 | 7.0 | 6.1 | 1.15 | 13539 | 57000 | 4.21 | 7 | 59% |
| Toner 10 | 7.0 | 5.9 | 1.19 | 13000 | 56200 | 4.32 | 9 | 61% |
| Toner 11 | 7.0 | 5.9 | 1.19 | 12800 | 56690 | 4.43 | 11 | 61% |
| Toner 12 | 6.7 | 5.9 | 1.14 | 11000 | 48315 | 4.39 | 10 | 56% |
| Toner 13 | 7.0 | 6.1 | 1.15 | 11500 | 52699 | 4.58 | 9 | 69% |
| Toner 14 | 7.0 | 5.3 | 1.32 | 13271 | 46577 | 3.51 | 13 | 58% |
| Toner 15 | 7.2 | 5.7 | 1.26 | 13004 | 45056 | 3.46 | 9 | 66% |
| Toner 16 | 7.0 | 5.8 | 1.21 | 9700 | 46642 | 4.81 | 17 | 55% |
| Toner 17 | 6.7 | 5.6 | 1.20 | 10707 | 53409 | 4.99 | 6 | 69% |
| Toner 18 | 7.0 | 5.9 | 1.19 | 10489 | 52249 | 4.98 | 17 | 55% |
| Toner 19 | 6.9 | 5.9 | 1.17 | 10271 | 47971 | 4.67 | 28 | 65% |
| Toner 20 | 7.5 | 5.5 | 1.36 | 10033 | 35507 | 3.54 | 20 | 56% |
| Toner 21 | 7.0 | 5.1 | 1.37 | 11600 | 48648 | 4.19 | 10 | 61% |
| Toner 22 | 7.7 | 5.5 | 1.40 | 11550 | 48648 | 4.21 | 10 | 61% |
| Toner 23 | 7.2 | 4.9 | 1.47 | 11600 | 48648 | 4.19 | 10 | 61% |
| Toner 24 | 7.0 | 5.6 | 1.25 | 11400 | 48648 | 4.27 | 10 | 61% |
| Toner 25 | 6.8 | 5.2 | 1.31 | 11300 | 48648 | 4.31 | 10 | 61% |
| Toner 26 | 6.7 | 5.2 | 1.29 | 11500 | 48648 | 4.23 | 10 | 61% |
| Toner 27 | 7.0 | 5.4 | 1.30 | 9866 | 34473 | 3.49 | 10 | 61% |
| Toner 28 | 7.0 | 5.5 | 1.27 | 9700 | 41274 | 4.26 | 10 | 61% |
| Toner 29 | 7.1 | 5.2 | 1.37 | 12736 | 45825 | 3.60 | 10 | 61% |
| Toner 30 | 6.9 | 5.6 | 1.23 | 12468 | 46184 | 3.70 | 10 | 61% |
| Toner 31 | 6.8 | 5.2 | 1.31 | 12200 | 39045 | 3.20 | 20 | 61% |
| Toner 32 | 7.7 | 5.5 | 1.40 | 11932 | 40555 | 3.40 | 12 | 57% |
| Toner 33 | 7.0 | 5.5 | 1.27 | 11664 | 41963 | 3.60 | 10 | 53% |
| Toner 34 | 7.0 | 5.9 | 1.19 | 11396 | 43270 | 3.80 | 10 | 71% |
| Toner 35 | 7.0 | 5.1 | 1.37 | 11000 | 43979 | 4.00 | 2 | 83% |
| Toner 36 | 7.2 | 5.5 | 1.31 | 11500 | 48175 | 4.19 | 10 | 84% |

TABLE 6-continued

| | | | | | | | | |
|---|---|---|---|---|---|---|---|---|
| Toner 37 | 7.1 | 5.6 | 1.27 | 9700 | 42797 | 4.41 | 10 | 86% |
| Toner 38 | 7.0 | 5.6 | 1.25 | 10707 | 34500 | 3.22 | 2.5 | 66% |
| Toner 39 | 7.0 | 5.1 | 1.37 | 13700 | 52797 | 3.85 | 10 | 53% |

| | THF-insoluble matter analysis of resin components | | | | Melting point of | Equivalent amount of double bonds | Storage elastic modulus of toner | | | |
|---|---|---|---|---|---|---|---|---|---|---|
| | Proportion % by mass | Tm (° C.) | H(I) J/g | Tg (° C.) | toner (° C.) | in toner (mmol/g) | G'(50) [$\times 10^8$ Pa] | G'(100) [$\times 10^5$ Pa] | G'(150) [$\times 10^5$ Pa] | $AV_W - AV_A$ |
| Toner 1 | 60 | 62.0 | 25.8 | 45 | 90.0 | 0.25 | 1.1 | 1.6 | 1.1 | 12 |
| Toner 2 | 61 | 61.0 | 17.9 | 46 | 95.0 | 0.24 | 1.2 | 1.7 | 1.2 | 12 |
| Toner 3 | 58 | 61.0 | 10.6 | 47 | 88.0 | 0.21 | 1.3 | 1.8 | 1.3 | 12 |
| Toner 4 | 65 | 61.0 | 64.0 | 48 | 100.0 | 0.20 | 1.1 | 1.6 | 1.1 | 12 |
| Toner 5 | 57 | 62.0 | 26.7 | 49 | 90.0 | 0.30 | 1.2 | 1.7 | 1.2 | 12 |
| Toner 6 | 52 | 62.0 | 70.7 | 45 | 84.0 | 0.20 | 1.1 | 1.2 | 1.1 | 12 |
| Toner 7 | 54 | 62.0 | 55.2 | 46 | 86.0 | 0.21 | 1.2 | 1.3 | 1.2 | 12 |
| Toner 8 | 56 | 62.0 | 48.5 | 47 | 88.0 | 0.26 | 1.1 | 1.4 | 1.3 | 12 |
| Toner 9 | 65 | 62.0 | 17.2 | 47 | 94.0 | 0.28 | 1.3 | 1.6 | 1.5 | 12 |
| Toner 10 | 60 | 56.0 | 23.3 | 45 | 90.0 | 0.25 | 1.3 | 0.55 | 0.05 | 12 |
| Toner 11 | 60 | 76.0 | 28.4 | 51 | 90.0 | 0.25 | 1.1 | 1.6 | 1.1 | 12 |
| Toner 12 | 75 | 61.0 | 22.7 | 37 | 90.0 | 0.25 | 1.2 | 1.7 | 1.2 | 12 |
| Toner 13 | 42 | 61.0 | 29.4 | 23 | 78.0 | 0.25 | 1.1 | 0.55 | 0.05 | 12 |
| Toner 14 | 70 | 61.0 | 30.6 | 40 | 125.0 | 0.20 | 1.2 | 1.7 | 1.2 | 12 |
| Toner 15 | 50 | 61.0 | 26.1 | 35 | 78.0 | 0.04 | 1.3 | 1.8 | 1.3 | 12 |
| Toner 16 | 78 | 59.0 | 37.7 | 45 | 135.0 | 0.61 | 1.3 | 7.5 | 7 | 12 |
| Toner 17 | 42 | 62.0 | 19.6 | 42 | 70.0 | 0.25 | 1.4 | 1.9 | 1.4 | 12 |
| Toner 18 | 78 | 59.0 | 37.7 | 52 | 135.0 | 0.25 | 1.3 | 7.5 | 7 | 12 |
| Toner 19 | 52 | 61.0 | 79.2 | 43 | 80.0 | 0.25 | 1.4 | 1.9 | 1.4 | 12 |
| Toner 20 | 74 | 61.0 | 45.7 | 50 | 128.0 | 0.25 | 1.3 | 5.5 | 5 | 12 |
| Toner 21 | 60 | 62.0 | 25.8 | 45 | 90.0 | 0.25 | 1.3 | 1 | 0.5 | −2 |
| Toner 22 | 60 | 62.0 | 25.8 | 46 | 90.0 | 0.25 | 1.3 | 1.1 | 0.6 | −2 |
| Toner 23 | 60 | 62.0 | 25.8 | 47 | 90.0 | 0.25 | 1.5 | 1.1 | 0.6 | 28 |
| Toner 24 | 60 | 62.0 | 25.8 | 48 | 90.0 | 0.25 | 1.3 | 1.1 | 0.6 | −2 |
| Toner 25 | 60 | 62.0 | 25.8 | 49 | 90.0 | 0.25 | 1.5 | 2 | 1.5 | −2 |
| Toner 26 | 60 | 62.0 | 25.8 | 50 | 90.0 | 0.25 | 1.3 | 1.8 | 1.3 | −2 |
| Toner 27 | 60 | 62.0 | 25.8 | 51 | 90.0 | 0.24 | 1.3 | 1.8 | 1.3 | 2 |
| Toner 28 | 60 | 62.0 | 25.8 | 45 | 90.0 | 0.24 | 1.5 | 2 | 1.5 | −6 |
| Toner 29 | 60 | 62.0 | 25.8 | 60 | 90.0 | 0.25 | 1.3 | 1.8 | 1.3 | 12 |
| Toner 30 | 60 | 62.0 | 25.8 | 46 | 90.0 | 0.24 | 1.5 | 2 | 1.5 | 12 |
| Toner 31 | 60 | 63.0 | 51.7 | 45 | 110.0 | 0.13 | 1.1 | 1.6 | 1.1 | 12 |
| Toner 32 | 73 | 63.0 | 27.6 | 46 | 132.0 | 0.40 | 1.3 | 5.5 | 5 | 12 |
| Toner 33 | 85 | 62.0 | 21.2 | 47 | 90.0 | 0.24 | 1.3 | 1.8 | 1.3 | 12 |
| Toner 34 | 38 | 62.0 | 35.0 | 48 | 90.0 | 0.25 | 1.3 | 1.8 | 1.3 | 12 |
| Toner 35 | 20 | 61.0 | 11.5 | 49 | 90.0 | 0.00 | 1.5 | 2 | 1.5 | −2 |
| Toner 36 | 18 | 61.0 | 62.8 | 50 | 90.0 | 0.14 | 1.3 | 1.8 | 1.3 | −2 |
| Toner 37 | 15 | 61.0 | 73.3 | 51 | 90.0 | 0.36 | 1.5 | 2 | 1.5 | −2 |
| Toner 38 | 50 | 61.0 | 7.3 | 52 | 128.0 | 0.25 | 1.3 | 5.5 | 5 | −2 |
| Toner 39 | 85 | 112.0 | 21.2 | 60 | 135.0 | 0.86 | 1.5 | 7.5 | 7 | −2 |

The unit of particle diameter is m.

TABLE 6

| | Name | Tm | Peak top molecular weight Mp | Acid value [mg KOH/g] |
|---|---|---|---|---|
| Release agent 1 | EXCEREX 15341PA | 89 | 1700 | 14 |
| Release agent 2 | EXCEREX 30050B | 91 | 2700 | 0 |
| Release agent 3 | Hi-WAX HP10A | 116 | 900 | 0 |
| Release agent 4 | Hi-WAX 2203A | 107 | 2700 | 30 |
| Release agent 5 | EXCEREX 20700 | 124 | 2000 | 0 |
| Release agent 6 | C105 | 105 | 500 | 0 |
| Release agent 7 | HNP9 | 70 | 500 | 0 |

The unit of Tm is ° C.

EXCEREX 15341PA, EXCEREX 30050B, EXCEREX 20700, Hi-Wax HIP10A, Hi-Wax 2203A are purchased from Mitsui Chemicals, Inc.

C105 is purchased from Sasol.

HNP9 is purchased from Nipon Seiro Co., Ltd.

Production Example of Binder Resin C33

A total of 50.0 parts of the polyester resin B13 and 50.0 parts of the polyester resin B14 were mixed, and the mixture was supplied to a twin-screw kneader (manufactured by Kurimoto Iron Works, Ltd., S5KRC kneader) at 40 kg/h, and at the same time, 4.0 parts of t-butylperoxyisopropyl monocarbonate as a radical reaction initiator was supplied at 0.4 kg/h, and the reaction was performed by kneading and extruding at 100 rpm for 5 minutes at 160° C. Mixing was then performed while causing nitrogen to flow from a vent port to remove the organic solvent. A binder resin C33 was obtained by cooling the mixture obtained. The number average molecular weight Mn was 14,200 and the weight average molecular weight Mw was 53,300.

Production Example of Toner Particles 39

| | |
|---|---|
| Binder resin C33 | 100.0 parts |
| Spherical magnetic iron oxide particles (number average | 95.0 parts |

-continued

| | |
|---|---|
| particle diameter of primary particles: 0.20 μm, Hc = 6.0 kA/m, σs = 85.2 $Am^2/kg$, σr = 6.5 $Am^2/kg$) | |
| Release agent 1 (EXCEREX 15341PA, molecular weight (Mp) 1700, melting point 89° C., manufactured by Mitsui Chemicals, Inc.) | 4.0 parts |
| Charge control agent T-77 (manufactured by Hodogaya Chemical Co., Ltd.) | 2.0 parts |

The above materials were premixed with an FM mixer (manufactured by Nippon Coke Industry Co., Ltd.), and then melt-kneaded at a set temperature of 160° C. by a twin-screw kneading extruder (PCM-30 type manufactured by Ikegai Tekko Co., Ltd.).

The obtained kneaded product was cooled, coarsely pulverized with a hammer mill, and then pulverized with a mechanical pulverizer (T-250 manufactured by Turbo Kogyo Co., Ltd.). The obtained finely pulverized powder was classified using a multi-zone classifier using a Coanda effect to obtain toner particles 39 having a weight average particle diameter (D4) of 7.0 m.

Production Example of Toner 39

A total of 100 parts of the toner particles 39 and 2.0 parts of hydrophobic silica fine powder (number average particle diameter of primary particles: 10 nm, BET specific surface area of original silica 200 $m^2/g$) were external-addition mixed with a FM mixer (manufactured by Nippon Coke Industry Co., Ltd.) to obtain a toner 39. Table 5 shows the physical properties of the toner 39.

Evaluation Methods

Example 1

The evaluation machine was a commercially available magnetic one-component printer HP LaserJet Enterprise M609dn (manufactured by Hewlett-Packard Co.: process speed 420 mm/s). The following evaluations using the toner 1 were carried out with the evaluation machine.

Evaluation of Low-Temperature Fixability

An external fixing device obtained by taking out the fixing device of the M609dn and modifying to enable arbitrary setting of the fixing device temperature and to set the process speed to 450 mm/sec was used to evaluate the low-temperature fixability.

As the evaluation paper, A4 paper ("PROBER BOND PAPER": 105 $g/m^2$, manufactured by Fox River Paper Co.) was used. The development contrast of the M609dn was adjusted so that the laid-on level of the toner on the paper was 0.6/$cm^2$, and a "solid" unfixed image having a tip margin of 5 mm, a width of 100 mm and a length of 100 mm was created in a single-color mode under the normal-temperature and normal-humidity environment (temperature 23.0° C./relative humidity 50%).

Also, the pressure during fixing was set to 1.00 $kgf/cm^2$. Using the modified fixing device, the fixing temperature was increased by 5° C. in the range of from 80° C. to 140° C. under normal-temperature and normal-humidity environment (temperature 23° C./relative humidity 50%), and kept constant for 3 minutes to obtain a fixed image of each unfixed image at each temperature. The temperature at which no white spots occurred on the obtained fixed image was defined as a fixing start temperature, and the low-temperature fixability was evaluated according to the following evaluation criteria. In the present invention, ranks A to C were determined to correspond to satisfactory low-temperature fixability. Table 7 shows the evaluation results.

Evaluation Criteria

A: fixing start temperature is less than 120° C.

B: fixing start temperature is 120° C. or higher and lower than 130° C.

C: fixing start temperature is 130° C. or higher and lower than 140° C.

D: fixing start temperature is 140° C. or higher

Evaluation of Density Unevenness

A total of 100 all-solid images were continuously outputted as sample images with the M609dn under a normal-temperature and normal-humidity environment (23° C., 60% RH), and the last 5 images therefrom were obtained. Nine points were uniformly selected for each of the obtained all-solid images, and the reflection density was measured using an SPI filter with a Macbeth densitometer (manufactured by Macbeth Co.) which is a reflection densitometer.

The difference was calculated from the maximum and minimum values of the density of 9 points, and the image unevenness at the time of fixing was evaluated from the average of this difference found for 5 prints. In the present invention, ranks A to C were determined to correspond to satisfactory density unevenness. Table 7 shows the evaluation results.

Evaluation Criteria

A: less than 0.04

B: 0.04 or more and less than 0.06

C: 0.06 or more and less than 0.08

D: 0.08 or more

Evaluation of Hot Offset Resistance

An external fixing device obtained by taking out the fixing device of the M609dn and modifying to enable arbitrary setting of the fixing device temperature and to set the process speed to 450 mm/sec was used to evaluate the hot offset resistance. As the evaluation paper, A4 paper ("PROBER BOND PAPER": 105 $g/m^2$, manufactured by Fox River Paper Co.) was used.

The development contrast of the M609dn was adjusted so that the laid-on level of the toner on the paper was 0.3/$cm^2$, and a "solid" unfixed image having a tip margin of 5 mm, a width of 100 mm and a length of 100 mm was created in a single-color mode under the normal-temperature and normal-humidity environment (temperature 23.0° C./relative humidity 50%).

Also, the pressure during fixing was set to 1.00 $kgf/cm^2$. Using the modified fixing device, a fixed image at 180° C. was obtained under normal-temperature and normal-humidity environment (temperature 23° C./relative humidity 50%). The density is measured when offset occurs during the second rotation of the fixing roller on the rear end side of the site at the "solid" is fixed. A reflection density was measured using an SPI filter with a Macbeth densitometer (manufactured by Macbeth Co.) which is a reflection densitometer, and the difference from the white background was taken as an offset density.

Hot offset resistance was evaluated according to the following evaluation criteria. In the present invention, ranks A to C were determined to correspond to satisfactory hot offset resistance. Table 7 shows the evaluation results.

Evaluation Criteria

A: no offset is seen, or the offset density on the second turn is less than 0.02

B: offset density on the second turn is 0.02 or more and less than 0.05

C: offset density on the second turn is 0.05 or more and less than 0.10.

D: offset density on the second turn is 0.10 or more

Evaluation of Heat-Resistant Storage Stability

A total of 5 g of the toner 1 was precisely weighed twice and allowed to stand for 24 hours in a 23° C., 60% RH environment and a 30° C., 80% RH environment. The agglomeration degree of the toner after each standing was measured by the above <Measurement of Degree of Agglomeration of Toner>. The increase ratio of the degree of agglomeration of the toner left in the environment of 30° C. and 80% RH, where the degree of agglomeration of the toner left in the environment of 23° C. and 60% RH was 100%, was evaluated according to the following criteria. The smaller the increase rate, the better the heat-resistant storage stability. Table 7 shows the evaluation results.

Evaluation Criteria

A: increase ratio of degree of agglomeration is less than 5%

B: increase ratio of degree of agglomeration is 5% or more and less than 10%

C: increase ratio of degree of agglomeration is 10% or more and less than 20%

D: increase ratio of degree of agglomeration is 20% or more

Evaluation of Reduction Ratio of Triboelectric Charge Quantity of Toner Due to Continuous Shaking First, 1.0 g of the toner and 19.0 g of the magnetic carrier (Japan Imaging Society standard carrier, spherical carrier with surface-treated ferrite core (N-01)) were placed in a plastic bottle. The bottle was allowed to stand for 24 hours in a normal-temperature and normal-humidity environment (temperature 23° C., relative humidity 50%).

The above magnetic carrier and toner were put in a plastic bottle with a lid, and shaken for 1 minute at a speed of 4 reciprocations per second by using a shaker (YS-LD, manufactured by Yayoi Co., Ltd.) to prepare a two-component developer composed of the toner and the carrier in which the toner was charged.

Figure 2:
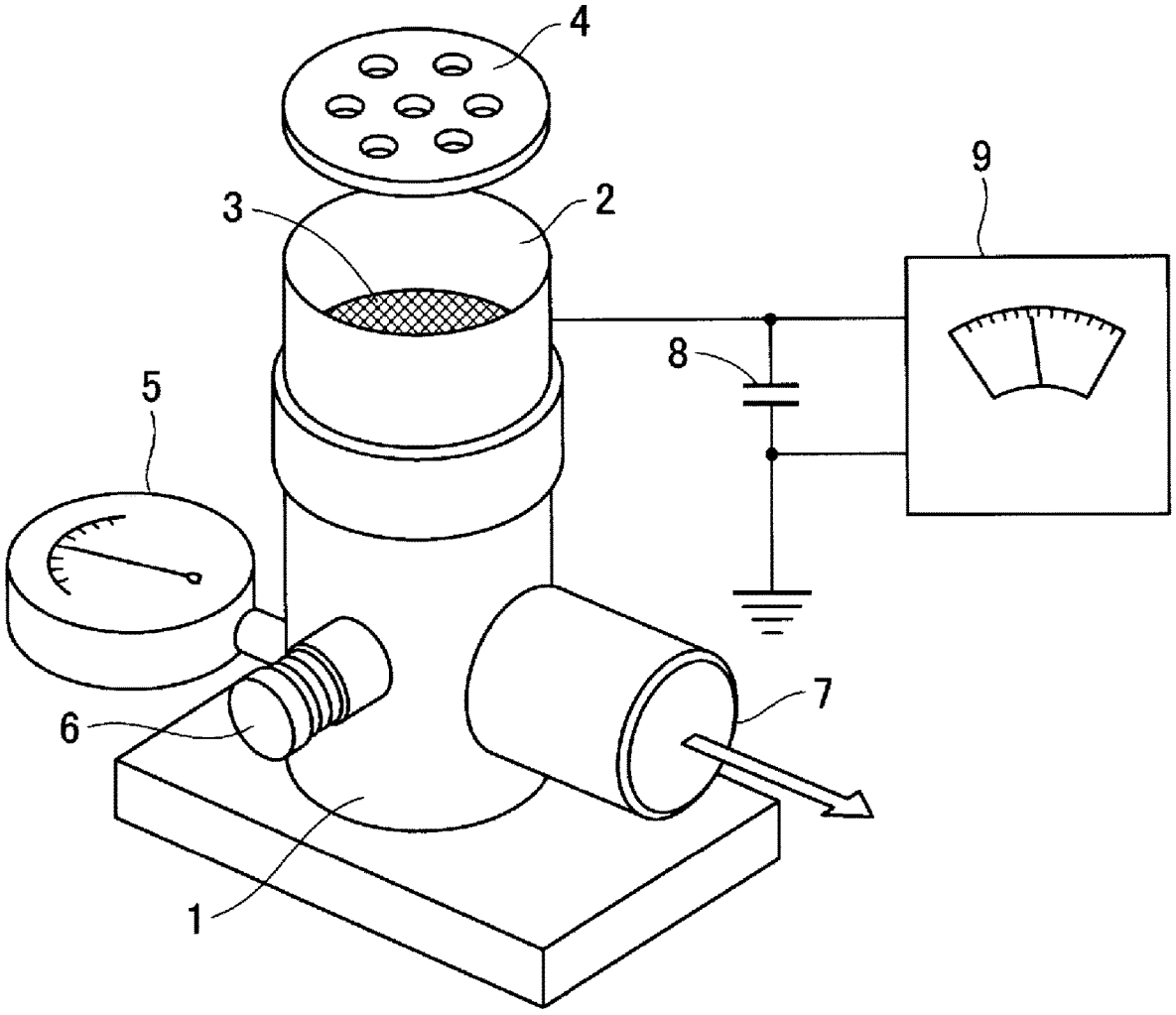
FIG. 2 is a schematic diagram of a device for measuring a triboelectric charge quantity.

Next, the triboelectric charge quantity was measured using the measuring device shown in FIG. 2. In FIG. 2, about 0.5 g of the abovementioned two-component developer was put into a metal measurement container 2 having a 500 mesh screen 3 on the bottom, and a metal lid 4 was put thereon. At this time, the total mass of the measurement container was weighed and taken as W1 (kg).

Next, in a suction device 1 (at least a part in contact with the measurement container 2 is an insulator), suction was performed from the suction port 7, and the air flow control valve 6 was adjusted to bring the pressure of the vacuum gauge 5 to 2.5 kPa. In this state, suction was performed for 2 minutes to remove the toner in the developer by suction. The potential of an electrometer 9 at this time was taken as V (volt). Here, the reference numeral 8 stands for a capacitor, and the capacitance is C (mF). The mass of the entire measurement container after suction was weighed and was taken as W2 (g).

The triboelectric charge quantity Q (1) [mC/kg] of this sample when shaken for 1 minute was calculated by the following formula (5).

$$Q(1)[\text{mC/kg}]=(C\times V)/(W1-W2) \quad (5)$$

The triboelectric charge quantity Q(30) when shaking for 30 minutes at a speed of 4 reciprocations per second was measured in a similar manner. The triboelectric charge quantity reduction rate in the present invention was calculated by the following formula.

$$(\text{Triboelectric charge quantity reduction ratio})(\%)=\{(Q(1)-Q(30))/Q(1)\}\times 100$$

In this evaluation, the reduction ratio in the triboelectric charge quantity refers to the degree to which the toner deteriorates due to friction with the magnetic carrier. It is considered that the lower the reduction ratio, the higher the stress resistance. That is, in the present invention, ranks A to C were determined to correspond to satisfactory charging performance. Table 7 shows the evaluation results.

Evaluation Criteria

A: reduction ratio of triboelectric charge quantity is less than 10%

B: reduction ratio of triboelectric charge quantity is 10% or more and less than 15%

C: reduction ratio of triboelectric charge quantity is 15% or more and less than 20%

D: reduction ratio of triboelectric charge quantity is 20% or more

Examples 2 to 32

The evaluation was performed in the same manner as in Example 1 except that the toners 2 to 32 were used. Table 7 shows the evaluation results.

Comparative Examples 1 to 7

The evaluation was performed in the same manner as in Example 1 except that Toners 33 to 39 were used. Table 7 shows the evaluation results of Comparative Examples 1 to 7.

TABLE 7

| | | Evaluation method 1 | | Evaluation method 2 | | Evaluation method 3 | | Evaluation method 4 | | Evaluaton method 5 | |
|---|---|---|---|---|---|---|---|---|---|---|---|
| | | | | | | | | Evaluation | Variation | | |
| | Toner | Evaluation of low-temperature fixability | Fixing start temperature | Evaluation of density un-evenness | Density uniformity | Evaluation of hot offset resistance | Density in second turn | of heat-resistant storage stability | ratio of degree of agglomer-ation | Evaluation of charging performance | Variation ratio of charge quantity |
| Example1 | Toner 1 | A | 115 | A | 0.01 | A | 0.01 | A | 3 | A | 3 |
| Example2 | Toner 2 | B | 120 | B | 0.04 | A | 0.01 | A | 3 | A | 3 |
| Example3 | Toner 3 | B | 125 | A | 0.01 | A | 0.01 | A | 3 | A | 3 |
| Example4 | Toner 4 | A | 115 | A | 0.02 | B | 0.03 | A | 2 | B | 12 |
| Example5 | Toner 5 | B | 125 | A | 0.01 | A | 0.01 | A | 2 | A | 2 |
| Example6 | Toner 6 | A | 105 | A | 0.01 | C | 0.07 | A | 3 | A | 3 |
| Example7 | Toner 7 | A | 115 | A | 0.02 | B | 0.03 | A | 3 | A | 3 |
| Example8 | Toner 8 | B | 120 | A | 0.01 | A | 0.01 | A | 3 | A | 3 |
| Example9 | Toner 9 | C | 130 | A | 0.01 | A | 0.01 | A | 3 | A | 3 |

TABLE 7-continued

| | Toner | Evaluation method 1 | | Evaluation method 2 | | Evaluation method 3 | | Evaluation method 4 | | Evaluaton method 5 | |
|---|---|---|---|---|---|---|---|---|---|---|---|
| | | Evaluation of low-temperature fixability | Fixing start temperature | Evaluation of density un-evenness | Density uniformity | Evaluation of hot offset resistance | Density in second turn | Evaluation of heat-resistant storage stability | Variation ratio of degree of agglomer-ation | Evaluation of charging performance | Variation ratio of charge quantity |
| Example10 | Toner 10 | A | 110 | B | 0.04 | C | 0.07 | C | 10 | A | 3 |
| Example11 | Toner 11 | B | 125 | A | 0.01 | A | 0.01 | A | 3 | A | 3 |
| Example12 | Toner 12 | B | 125 | A | 0.03 | A | 0.01 | A | 4 | A | 4 |
| Example13 | Toner 13 | A | 115 | A | 0.03 | B | 0.04 | C | 10 | A | 4 |
| Example14 | Toner 14 | B | 120 | A | 0.01 | A | 0.01 | A | 2 | A | 4 |
| Example15 | Toner 15 | A | 115 | B | 0.04 | A | 0.01 | A | 4 | A | 2 |
| Example16 | Toner 16 | B | 120 | A | 0.01 | A | 0.01 | A | 2 | C | 15 |
| Example17 | Toner 17 | A | 115 | B | 0.05 | A | 0.01 | A | 4 | A | 3 |
| Example18 | Toner 18 | C | 130 | A | 0.01 | A | 0.01 | A | 3 | A | 3 |
| Example19 | Toner 19 | A | 115 | A | 0.02 | B | 0.03 | A | 4 | A | 4 |
| Example20 | Toner 20 | B | 120 | A | 0.02 | B | 0.03 | A | 4 | A | 4 |
| Example21 | Toner 21 | A | 115 | C | 0.06 | B | 0.03 | C | 12 | C | 15 |
| Example22 | Toner 22 | B | 120 | C | 0.07 | B | 0.04 | A | 3 | C | 15 |
| Example23 | Toner 23 | B | 125 | C | 0.07 | B | 0.04 | A | 3 | A | 3 |
| Example24 | Toner 24 | A | 115 | C | 0.07 | C | 0.07 | A | 3 | A | 3 |
| Example25 | Toner 25 | A | 115 | C | 0.07 | C | 0.07 | B | 5 | C | 15 |
| Example26 | Toner 26 | C | 130 | C | 0.07 | C | 0.07 | B | 7 | C | 17 |
| Example27 | Toner 27 | B | 125 | B | 0.05 | B | 0.02 | A | 4 | A | 4 |
| Example28 | Toner 28 | C | 135 | C | 0.06 | B | 0.02 | A | 4 | A | 2 |
| Example29 | Toner 29 | A | 115 | A | 0.02 | B | 0.02 | A | 4 | A | 4 |
| Example30 | Toner 30 | A | 115 | A | 0.02 | B | 0.02 | A | 4 | A | 4 |
| Example31 | Toner 31 | A | 115 | C | 0.06 | B | 0.03 | C | 12 | C | 15 |
| Example32 | Toner 32 | C | 135 | C | 0.06 | B | 0.02 | A | 4 | A | 2 |
| Comparative Example 1 | Toner 33 | D | 140 | A | 0.01 | A | 0.01 | A | 4 | C | 16 |
| Comparative Example 2 | Toner 34 | A | 110 | D | 0.08 | D | 0.11 | C | 12 | C | 10 |
| Comparative Example 3 | Toner 35 | B | 120 | D | 0.1 | D | 0.1 | A | 4 | C | 12 |
| Comparative Example 4 | Toner 36 | B | 125 | D | 0.11 | D | 0.11 | B | 5 | C | 10 |
| Comparative Example 5 | Toner 37 | C | 130 | D | 0.11 | D | 0.11 | B | 6 | C | 13 |
| Comparative Example 6 | Toner 38 | C | 130 | D | 0.13 | D | 0.13 | C | 12 | C | 12 |
| Comparative Example 7 | Toner 39 | D | 140 | D | 0.13 | D | 0.15 | C | 12 | C | 12 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-151240, filed Aug. 21, 2019 which is hereby incorporated by reference herein in its entirety.

What is claimed is:

1. A toner, comprising, a binder resin comprising an amorphous segment and a crystalline segment as a binder resin;

the crystalline segment comprising a vinyl resin segment having crystallinity, the vinyl resin segment being a polymer $A_1$ segment which is a polymer of a monomer including a polymerizable monomer $A_1$;

polymerizable monomer $A_1$ being a (meth)acrylate with a chain hydrocarbon group having 18 to 36 carbon atoms, a mass ratio of polymerizable monomer $A_1$ unit in the polymer $A_1$ segment being 30 to 99% by mass, wherein a proportion of a tetrahydrofuran (THF)-insoluble matter of a resin component is 40 to 80% by mass calculated by proportion of a THF-insoluble matter of a resin component=(mass of THF-insoluble matter of a resin component in the toner)/(mass of a resin component in the toner)×100, and $55.0 \leq Tm \leq 80.0$ and $10.0 \leq H(I) \leq 80.0$ in differential scanning calorimeter measurement of the THF-insoluble matter where Tm [° C.] is a temperature of a maximum endothermic peak and H(I) [J/g] is an endothermic quantity.

2. The toner according to claim 1, wherein $16.5 \leq H(I) \leq 65.0$.

3. The toner according to claim 1, wherein the amorphous segment comprises an amorphous modified resin segment in which a vinyl resin having crystallinity and a polyester resin are crosslinked by carbon-carbon bonds.

4. The toner according to claim 3, wherein a segment derived from the vinyl resin in the modified resin segment is a polymer $A_2$ segment which is a polymer of a monomer including a polymerizable monomer $A_2$, polymerizable monomer $A_2$ being a (meth)acrylate having a chain hydrocarbon group with 18 to 36 carbon atoms, and a mass ratio of the polymerizable monomer $A_2$ unit in the polymer $A_2$ segment is 30 to 99% by mass.

5. The toner according to claim 1, wherein the binder resin comprises (i) a crosslinked polyester resin segment which is the amorphous segment and in which a vinyl resin having crystallinity and a polyester resin are crosslinked with each other by carbon-carbon bonds, and (ii) a vinyl resin segment which has crystallinity and is the crystalline segment.

6. The toner according to claim 1, wherein the THF-insoluble matter of the resin component has a glass transition temperature of 25 to 55° C.

7. The toner according to claim 1, wherein the toner has 0.50 mmol/g or less carbon-carbon double bonds based on the mass of the toner.

8. The toner according to claim 1, wherein a half outflow temperature of the toner in a temperature rise measurement by constant-load extrusion type rheometer is 80 to 130° C.

9. The toner according to claim 1, further comprising a release agent.

10. The toner according to claim 9, wherein the release agent has a peak molecular weight of 1000 or more.

11. The toner according to claim 9, wherein the release agent has a melting point of 80 to 120° C.

12. The toner according to claim 9, wherein the release agent has an acid value of 5.0 to 20.0 mg KOH/g.

13. The toner according to claim 9, wherein $AV_W > AV_A$ when $AV_W$ is an acid value of the release agent and $AV_A$ is an acid value of the amorphous segment.

14. The toner according to claim 1, wherein a storage elastic modulus G'(150) at 150° C. is $1.0\times10^4$ to $1.0\times10^7$ Pa in viscoelasticity measurement of the THF-insoluble matter of the toner.

* * * * *